US008433212B2

(12) United States Patent
Ono

(10) Patent No.: US 8,433,212 B2
(45) Date of Patent: Apr. 30, 2013

(54) IMAGE FORMING APPARATUS SETTING DIFFERENT TARGET TEMPERATURES OF AN IMAGE HEATING DEVICE DEPENDING ON THE IMAGE FORMING MODES

(75) Inventor: Kazuaki Ono, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 538 days.

(21) Appl. No.: 12/698,389

(22) Filed: Feb. 2, 2010

(65) Prior Publication Data

US 2010/0196039 A1 Aug. 5, 2010

(30) Foreign Application Priority Data

Feb. 3, 2009 (JP) ..... 2009-022720

(51) Int. Cl.
*G03G 15/20* (2006.01)
*G03G 15/00* (2006.01)

(52) U.S. Cl.
USPC ..... 399/69; 399/45

(58) Field of Classification Search ..... 399/45, 399/67, 69
See application file for complete search history.

(56) References Cited

U.S. PATENT DOCUMENTS

2006/0239703 A1* 10/2006 Kwon et al. ..... 399/45
2010/0189450 A1* 7/2010 Hosoda ..... 399/45

FOREIGN PATENT DOCUMENTS

JP 04-73785 3/1992
JP 04-322279 11/1992
JP 07-311506 11/1995

* cited by examiner

*Primary Examiner* — David Gray
*Assistant Examiner* — Andrew Do
(74) *Attorney, Agent, or Firm* — Fitzpatrick, Cella, Harper & Scinto

(57) ABSTRACT

An image forming apparatus includes: a device for forming a toner image on a sheet; a heater contacting and heating the toner image on the sheet; a detector for detecting a temperature of the heater a controller for controlling the heater to maintain the temperature of the heater at a target temperature based on an output of the detector; a selector for selecting a first mode continuously forming images on thin sheets, a second mode continuously forming images on thick sheets, and a third mode continuously forming images on the thin sheet and the thick sheet; and a setter for setting the target temperature based on the selected mode, wherein the target temperature in the second mode is higher than the target temperature in the first mode, and the target temperature in the third mode is higher than the target temperature in the second mode.

11 Claims, 9 Drawing Sheets

IMAGE FORMING APPARATUS SETTING DIFFERENT TARGET TEMPERATURES OF AN IMAGE HEATING DEVICE DEPENDING ON THE IMAGE FORMING MODES

FIELD OF THE INVENTION AND RELATED ART

The present invention relates to an image forming apparatus, which uses an electrophotographic image forming method. In particular, it relates to a copying machine, a printer, a facsimile machine, and the like.

An image forming apparatus, which transfers a toner image onto a sheet of a recording medium, and then, thermally fixes the toner image to the sheet of the recording medium, has an image heating apparatus which has a roller and a rotationally movable member (roller or belt). The roller and rotationally movable member form a nip for fixing the transferred image on the sheet of the recording medium to the sheet of the recording medium, by being pressed against each other. An image heating apparatus includes a thermally finishing apparatus which adjusts the surface glossiness of a temporarily fixed toner image or a fully fixed toner image by applying heat and pressure to the sheet of the recording medium and the image thereon, in addition to a fixing apparatus which fixes the transferred toner image on the sheet of the recording medium to the sheet of the recording medium.

In recent years, the field in which image forming apparatuses are used has significantly widened. With the widening of the field in which image forming apparatuses are used, image heating apparatuses are required to be able to deal with an image forming operation in which images are formed nonstop on a mixture of both a substantial number of sheets of a recording medium (cardboard, coated paper) that require a relatively large amount of heat to heat them, and a substantial number of sheets of a recording medium (thin paper) that require a relatively small amount of heat to heat them. An example of such an image forming operation is an image forming operation for creating booklets which have a cover, multiple thick paper sections, and multiple thin paper sections inserted among the thick paper sections, or booklets which have a cover, multiple plain paper sections, and multiple coated paper sections inserted among the plain paper sections, and the like booklets.

If the heat and pressure settings used for forming images nonstop on a substantial number of ordinary plain paper sheets are used for an image forming operation, such as the above-described one, in which images are formed nonstop on a mixture of a substantial number of sheets of coated paper, or a substantial number of sheets of thick plain paper, it is possible that the images on the sheets of coated paper, or the thick plain paper will fail to be properly fixed, or come out with an insufficient level of glossiness. The coated paper and the thick plain paper are larger in thermal capacity than ordinary plain paper. Therefore, in order to heat their surfaces to the same temperature level as that of ordinary paper (thin plain paper), the amount of heat supplied to them must be increased while they are conveyed through the fixation nip.

Japanese Laid-open Patent Application H04-73785 discloses an image heating apparatus which can change the amount of pressure it applies to its fixation roller and its pressure roller to form its fixation nip. In this case, for an image forming operation in which coated paper or thick paper is used as the recording medium, the amount of pressure applied to the pressure roller to keep the pressure roller pressed upon the fixation roller is increased to increase the fixation nip in the dimension in terms of the direction parallel to the rotational direction of the fixation roller, in order to increase the amount of heat applied to the recording medium while the recording medium is conveyed through the fixation nip.

Japanese Laid-open Patent Application H07-311506 also discloses an image heating apparatus which presses its pressure roller upon its fixation roller to form its fixation nip. In this case, for coated or thick paper, not only is its fixation speed reduced, but also, its fixation temperature is increased, to increase the amount of heat it supplies to the recording medium while the recording medium is conveyed through the fixation nip.

Japanese Laid-open Patent Application H04-322279 also discloses an image heating apparatus which presses its pressure roller upon its fixation roller to form its fixation nip. In the case of this image heating apparatus, the amount of heat supplied to coated paper or thick paper is increased by increasing the image interval (sheet interval) for coated paper or thick paper, compared to that for ordinary paper, so that the reduced surface temperature will recover.

If a fixing apparatus is controlled so that whether each sheet of the recording medium is a sheet of ordinary paper (thin paper) or a sheet of coated paper (thick paper) is checked, and then, the fixation setting of the fixing apparatus is changed, based on the recording-medium type, the productivity of the fixing apparatus is substantially reduced, compared to when it is used to form images nonstop on sheets of ordinary paper without checking the type of recording media.

In the case of the control disclosed in Japanese Laid-open Patent Application H04-73785, several seconds are required to change the amount of pressure to be applied to each sheet of the recording medium. Therefore, each time the recording medium is switched from ordinary paper to coated paper (thick paper), or from coated paper (thick paper) to ordinary paper, a nonstop image forming operation is interrupted for several seconds.

In the case of the control disclosed in Japanese Laid-open Patent Application H07-311506, several seconds are required to change the fixation temperature. Therefore, each time the recording medium is switched from ordinary paper to coated paper (thick paper), or from coated paper (thick paper) to ordinary paper, a nonstop image forming operation is interrupted for a substantial length of time.

In the case of the control disclosed in Japanese Laid-open Patent Application H04-322279, the number of sheets of a recording medium the heating apparatus can process per minute (PPM: Page Per Minute) is reduced by the amount proportional to the amount by which image interval (sheet interval) is extended.

Thus, a mixed-media-printing mode was proposed, in which images are formed nonstop on a mixture of sheets of ordinary paper and sheets of thick paper (coated paper) with a preset image interval (sheet interval), with the temperature and pressure of the fixation nip set to those used for a nonstop image forming operation in which images are formed nonstop on nothing but multiple sheets of thick paper (coated paper). For example, a mixed-media-printing mode is a printing mode to which the operational mode of a fixing apparatus is switched from the thick-paper mode or the ordinary-paper mode in a case where several tens of booklets made up of five sheets of thick paper, 30 sheets of ordinary paper, and five sheets of thick paper, are outputted.

The fixing apparatus disclosed in Japanese Laid-open Patent Application H07-311506 and the fixing apparatus disclosed in Japanese Laid-open Patent Application H04-322279, comprise a fixation roller made up of a cylindrical member, and an elastic layer which covers the entirety of the peripheral surface of the cylindrical member. The cylindrical member is made of a metallic material, and the elastic layer is made of rubber. In operation, the surface temperature of the elastic layer is detected, and the heating apparatus is controlled so that the surface temperature of the cylindrical member remains at, or near, a preset level.

It was discovered that as a fixing apparatus, such as the above-described ones, was operated in the mixed-media-printing mode, prints were produced that were unsatisfactory in image fixation and/or glossiness. For example, when five prints were made using sheets of thick paper after making 30 prints nonstop using sheets of ordinary paper, the fourth and fifth prints were unsatisfactory in image fixation and/or glossiness.

That is, in an operation in which multiple sheets of ordinary paper are heated (fixed) one after another, the amount of heat is taken from a fixing (heating) apparatus by the recording medium is relative small, and therefore, the difference in temperature level between the peripheral surface of the fixation roller and the cylindrical member of the fixation roller remains relatively small (FIG. 5). Therefore, the temperature of the cylindrical member decreases substantially more than in an operation in which multiple sheets of thick paper are heated one after another. In other words, in an operation in which multiple sheets of ordinary paper are heated one after another, the amount the surface temperature of the fixation roller decreases is relatively small, and therefore, the length of time the heater is kept turned off is relatively long. Therefore, the amount of heat that the cylindrical member receives from the heater is relatively small, and therefore, the cylindrical member decreases in temperature.

If a substantial number of sheets of thick paper begin to be heated one after another after the cylindrical member has substantially decreased in temperature, the surface temperature of the fixation roller, which fixes a toner image by coming into contact with the toner image, quickly falls to a level at which prints with an unsatisfactorily fixed image, and/or an unsatisfactory level of glossiness, will be outputted (FIG. 6).

SUMMARY OF THE INVENTION

It is a principal object of the present invention to provide an image forming apparatus with which images can be properly formed on mixed thin and thick sheets.

According an aspect of the present invention, there is provided an image forming apparatus comprising an image forming device configured to form a toner image on a sheet; an image heating device disposed to contact the toner image on the sheet and configured to heat the toner image on the sheet; a heating device configured to heat the image heating device; a detecting device configured to detect a temperature of the image heating device; a controlling device configured to control the heating device so that the temperature of the image heating device is maintained at a target temperature based on an output of the detecting device; a selecting device configured to select one of plurality of modes including a first mode in which the images are continuously formed on a plurality of thin sheets, a second mode in which the images are continuously formed on a plurality of thick sheets and a third mode in which the images are continuously formed on a plurality of sheets including the thin sheets and the thick sheets; and a setting device configured to set the target temperature based on the selected mode, wherein the target temperature in the second mode is higher than the target temperature in the first mode, and the target temperature in the third mode is higher than the target temperature in the second mode.

According to another aspect of the present invention, there is provided an image forming apparatus comprising an image forming device configured to form a toner image on a sheet; an image heating device, disposed so as to contact with the toner image on the sheet, configured to heat the toner image on the sheet at a nip portion; a nip forming device configured to form the nip portion by cooperating with the image heating device; a selecting device configured to select one of plurality of modes including a first mode in which the images are continuously formed on a plurality of thin sheets, a second mode in which the images are continuously formed on a plurality of thick sheets and a third mode in which the images are continuously formed on a plurality of sheets including the thin sheets and the thick sheets; and a setting device configured to set a pressure in the nip portion between the image heating device and the nip forming device, wherein the pressure in the second mode is higher than the pressure in the first mode, and the pressure in the third mode is substantially equal to the pressure in the second mode.

According to a further aspect of the present invention, there is provided an image forming apparatus comprising an image forming device configured to form a toner image on a sheet; an image heating device, disposed so as to contact the toner image on the sheet, configured to heat the toner image on the sheet; a heating device configured to heat the image heating device; a detecting device configured to detect a temperature of the image heating device; a heat controlling device configured to control the heating device so that the temperature of the image heating device is maintained at a target temperature based on an output of the detecting device; a selecting device configured to select one of plurality of modes including a first mode in which the images are continuously formed on a plurality of thin sheets, a second mode in which the images are formed on a plurality of thick sheet continuously, a third mode in which the images are continuously formed on the thick sheets and the thin sheets, the number of which is larger than the number of the thick sheets, and a fourth mode in which the images are continuously formed on the thin sheets and the thick sheets, the number of which is larger than a number of the thin sheets; and a setting device configured to set the target temperature based on the selected mode, wherein the target temperature in the second mode is higher than the target temperature in the first mode, the target temperature in the third mode is substantially equal to the target temperature in the second mode, and the target temperature in the fourth mode is higher than the target temperature in the third mode.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. Incidentally, the present invention can be embodied in forms other than those in the preferred embodiment which will be described hereafter, by partially or entirely replacing the structure of the image forming apparatus and/or fixing apparatus in the preferred embodiments, with corresponding replacement structure.

An image heating apparatus in accordance with the present invention can be used not only as an image heating apparatus for heating a toner image, but also, as a thermal finishing apparatus for finishing a temporarily fixed toner image so that it will have a preset level of glossiness, by applying heat and pressure to the temporarily fixed toner image, and the sheet of the recording medium on which the toner image is formed. Further, not only can an image forming apparatus in accordance with the present invention be mounted in a monochromatic image forming apparatus, such as the one shown in FIG. 1, but also, can be mounted in a full-color image forming apparatus of the intermediary-transfer type or direct-transfer type.

The rotational pressing member which forms the fixation nip by being pressed upon the rotational heating member does not need to be limited to a component in the form of a roller. It may be an endless belt supported by its inward surface by a pair or more of rotational members.

<Image Forming Apparatus>

Figure 1:
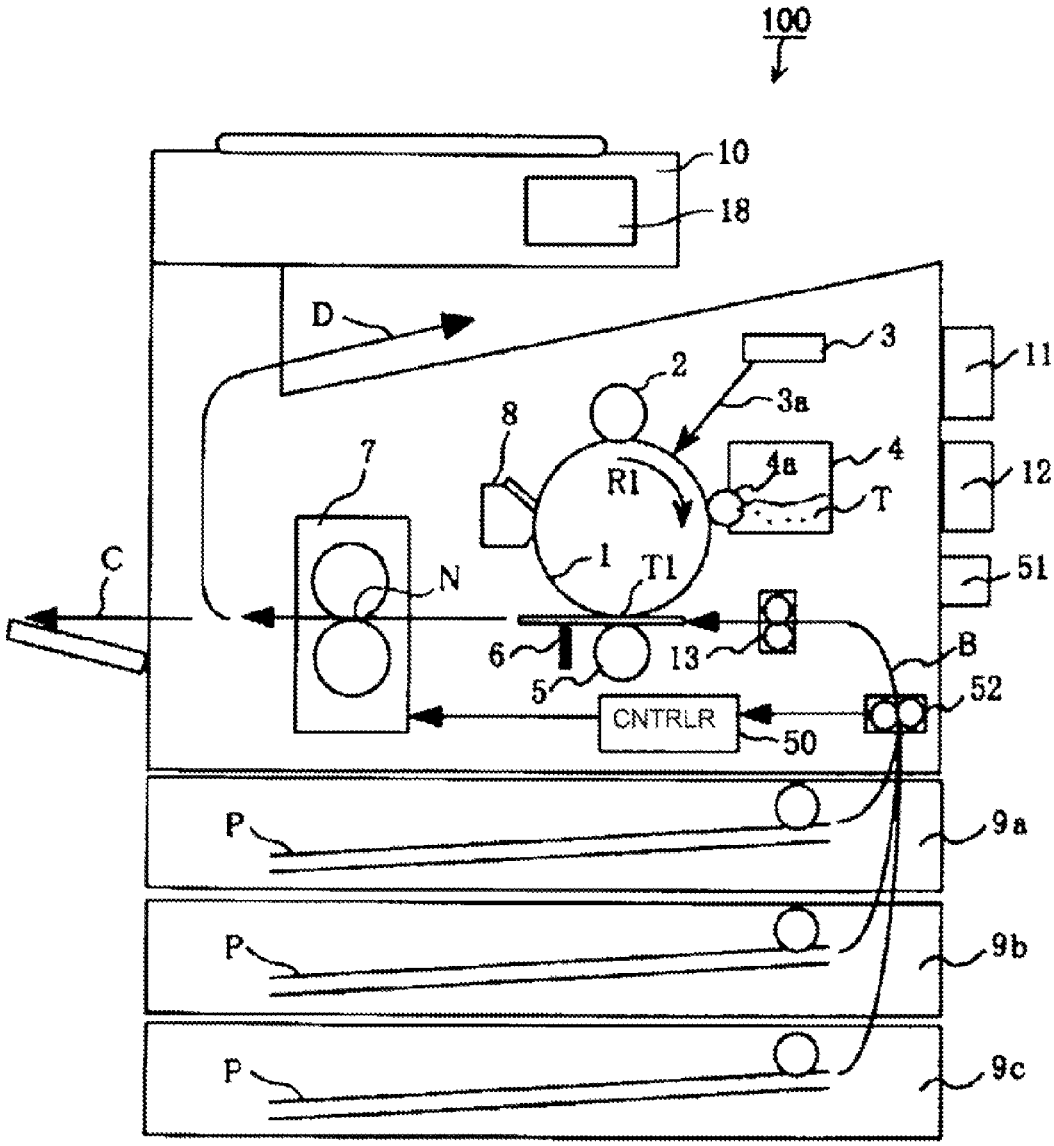
FIG. 1 is a sectional view of the image forming apparatus in the first embodiment of the present invention, and shows the general structure of the apparatus.

FIG. 1 is a sectional view of the image forming apparatus in the first embodiment of the present invention, and shows the general structure of the apparatus.

As is shown in FIG. 1, an image forming apparatus 100 has: an image scanner 10 which reads the image information of an original when the image forming apparatus 100 is in a copying mode; and a photosensitive drum 1. In a copying mode, the image forming apparatus 100 forms a toner image on the photosensitive drum 1, based on the image information from the image scanner, and transfers the toner image onto a sheet P of the recording medium (which hereafter may be referred to simply as recording medium P).

In a printing mode, the image forming apparatus 100 receives, through its printing data receiving means 11, the printing data that were generated by an unshown external apparatus, such as a personal computer, and sent to the image forming apparatus 100 by way of unshown communication lines. Then, the image forming apparatus 100 forms an image on the recording medium P, based on the print data (image information).

In a facsimile mode, the image forming apparatus 100 receives, through its facsimile data receiving means 12, the facsimile data that were generated by an unshown external apparatus, such as a personal computer, and sent to the image forming apparatus 100 by way of unshown communication lines. Then, the image forming apparatus 100 forms an image on the recording medium P, based on the facsimile data (image information).

In the recording-medium cassettes 9*a*, 9*b*, and 9*c*, multiple sheets P of a recording medium, more specifically, multiple sheets of ordinary paper (thin paper), multiple sheets of thick paper, and multiple sheets of coated paper are stored, respectively. The recording sheets P are taken out of the recording-medium cassettes 9*a*, 9*b*, or 9*c* as necessary. As a sheet P is taken out, it is separated from the rest of the sheets of the recording medium. Then, it is sent to a pair of registration rollers 13. The registration rollers 13 keep the recording medium P on standby, and then, send the recording medium P out to a transfer portion T1 in synchronism with the timing of the arrival of the toner image on the photosensitive drum 1 at the transfer portion T1. After the transfer of the toner image onto the recording medium P in the transfer portion T1, the recording medium P is conveyed through the fixation nip N of a fixing apparatus 7. While the recording medium P is conveyed through the fixation nip N, the toner image on the recording medium P is fixed to the surface of the recording medium P.

The image forming apparatus 100 has toner image forming means, more specifically, a charge roller 2, an exposing apparatus 3, a developing apparatus 4, and a transfer roller 5, and a cleaning apparatus 8, which are in the adjacencies of the peripheral surface of the photosensitive drum 1, positioned in the listed order.

The charge roller 2 uniformly charges the peripheral surface of the photosensitive drum 1 to a preset negative potential level (−400 V) by being provided with an oscillatory voltage, which is a combination of a DC voltage and an AC voltage, by an unshown electric power source.

The exposing apparatus 3 writes an electrostatic image (−50 V at exposed point) on the peripheral surface of the photosensitive drum 1 by scanning the peripheral surface of the photosensitive drum 1 with a beam of laser light while modulating (turning on and off) the beam with image signals created by developing the image data.

The developing apparatus 4 negatively charges the magnetic single-component toner, and makes its development sleeve 4*a* bear the negatively charged toner in thin layer. Then, it supplies the electrostatic image on the peripheral surface of the photosensitive drum 1 with the toner from the thin layer of toner on its development sleeve 4*a*. More specifically, as an oscillatory voltage, that is, a combination of a DC voltage (−250 V) and an AC voltage (1 Kvpp/2.5 KHz), is applied to the development sleeve 4*a*, the negatively charged toner transfers onto the exposed points of the peripheral surface of the photosensitive drum 1, which became positive relative to the unexposed points on the peripheral surface of the photosensitive drum 1. As a result, the electrostatic image is reversely developed.

The transfer roller 5 forms the transfer portion T1 by being pressed upon the photosensitive drum 1, and conveys the recording medium P through the transfer portion T1 so that the toner image on the peripheral surface of the photosensitive drum 1 aligns with the recording medium P. As a positive DC voltage (+2 KV) is applied to the transfer roller 5 from an unshown electric power source, the toner image is transferred from the photosensitive drum 1 to the recording medium P.

A charge removal needle 6 is on the downstream side of the transfer portion T1. It separates the recording medium P from the photosensitive drum 1 by irradiating the recording medium P with charged particles which result from the corona which is generated as negative charge is applied to charge needle 6.

The cleaning apparatus 8 removes the transfer residual toner, that is, the toner remaining on the peripheral surface of the photosensitive drum 1, on the downstream side of the transfer portion T1, by placing its cleaning blade in contact with the peripheral surface of the photosensitive drum 1.

<Fixing Apparatus>

Figure 2:
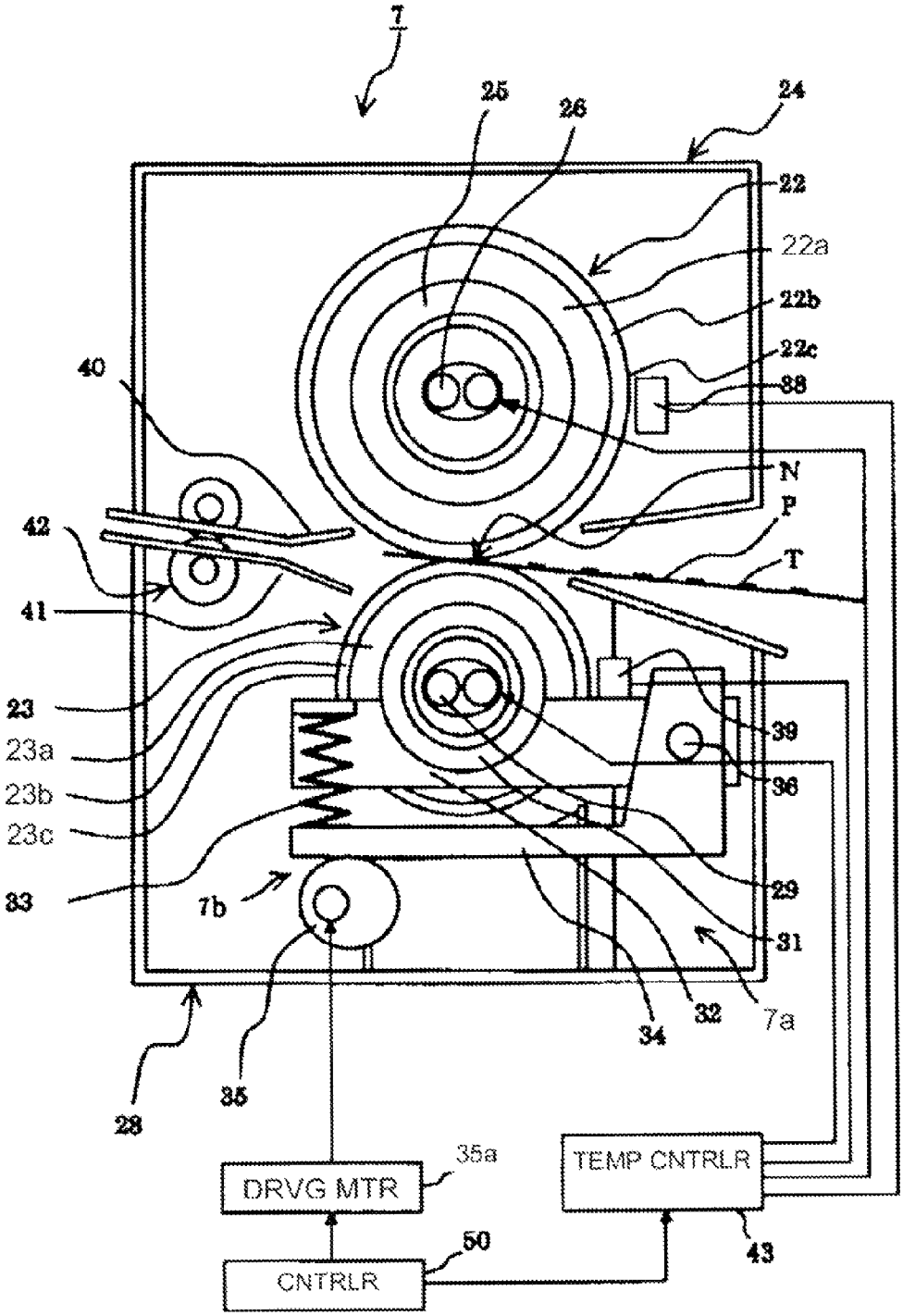
FIG. 2 is a sectional view of the fixing apparatus in the first embodiment of the present invention, and shows the general structure of the apparatus.
Figure 3:
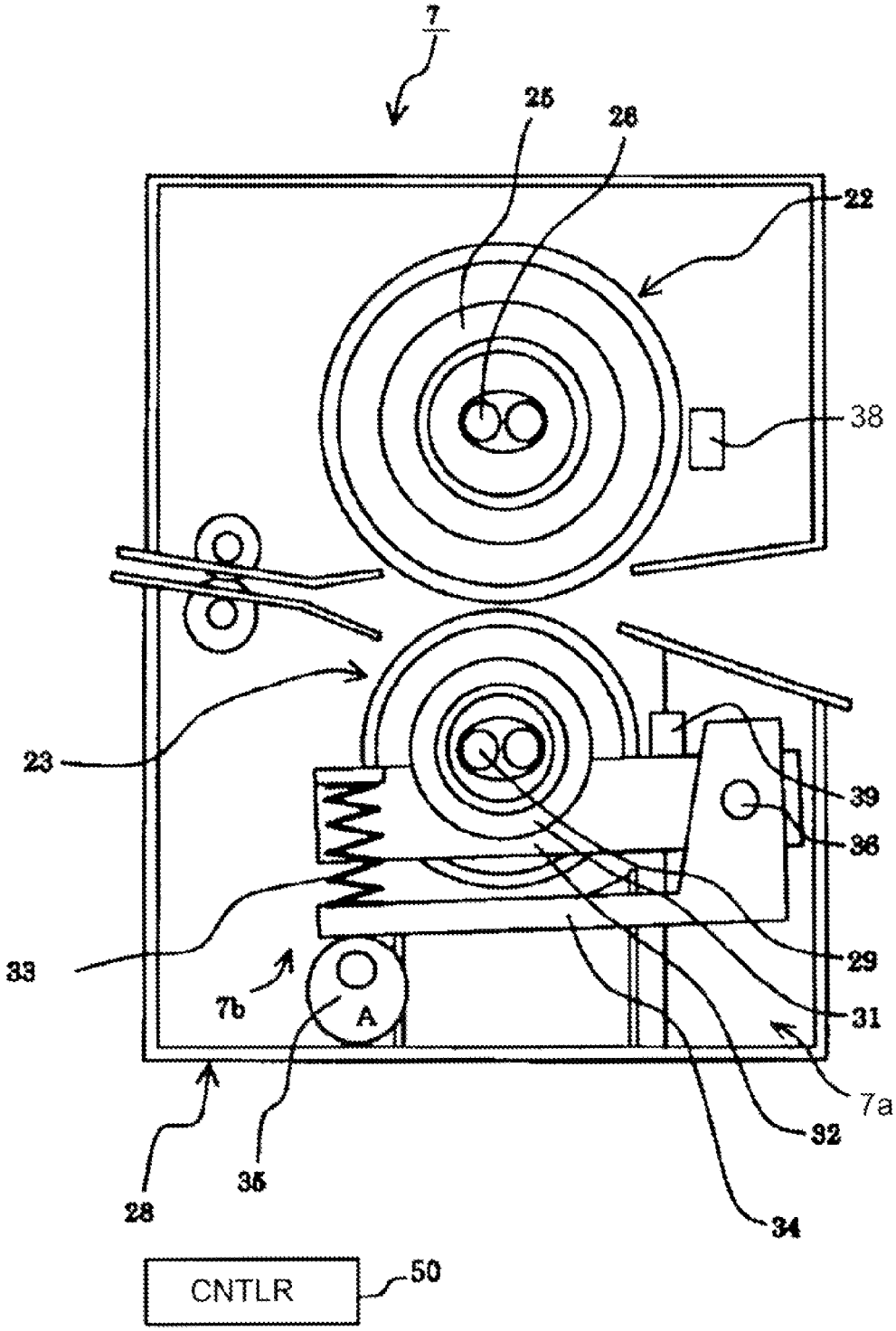
FIG. 3 is a sectional view of the fixing apparatus, in the first embodiment of the present invention, the pressure roller of which is not in contact with its fixation roller.
Figure 4:
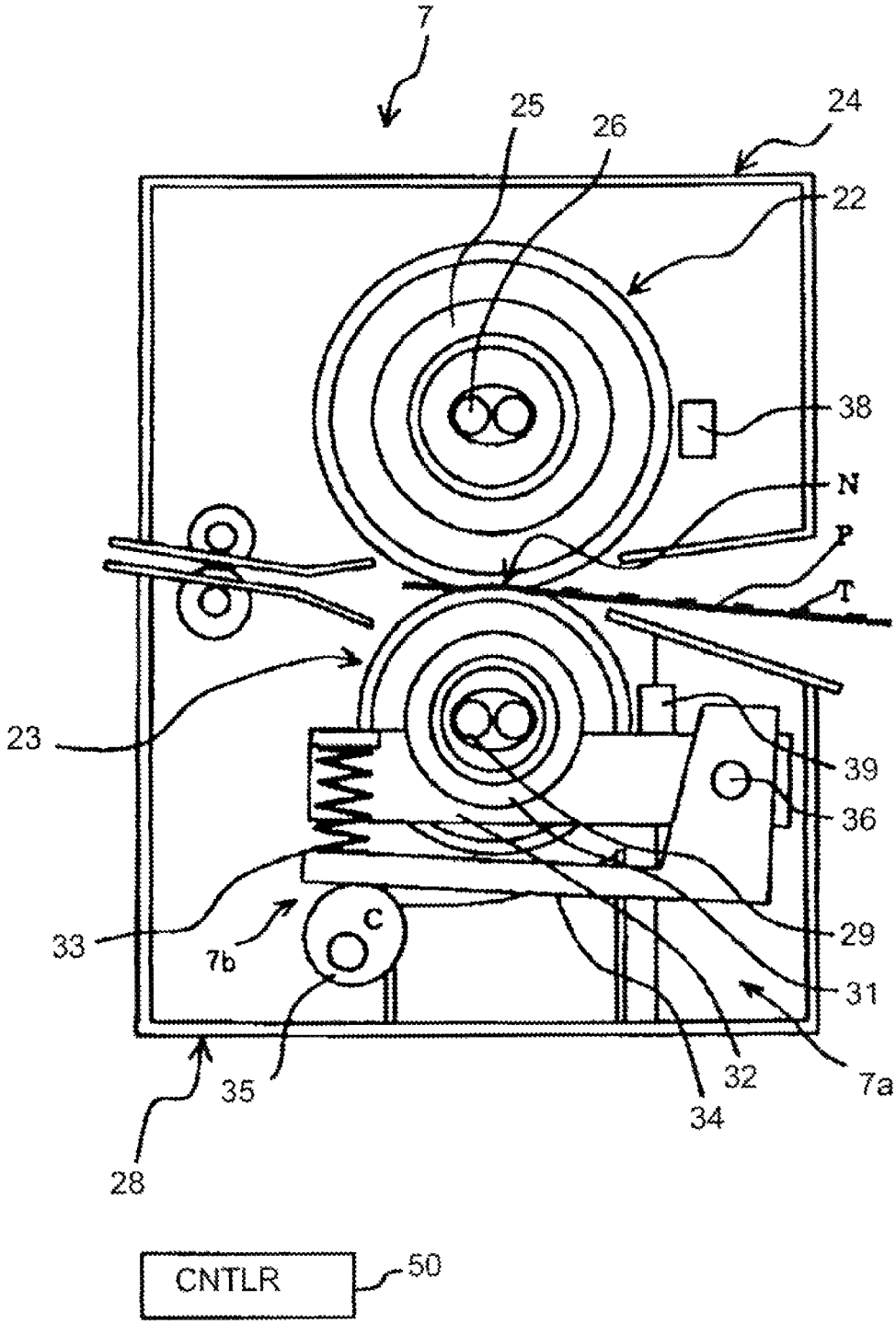
FIG. 4 is a sectional view of the fixing apparatus, in the first embodiment of the present invention, the pressure roller of which remains pressed upon its fixation roller.

FIG. 2 is a drawing for illustrating the structure of the fixing apparatus. FIG. 3 is a drawing for illustrating the fixing apparatus when the fixation roller of the fixing apparatus is not in contact with the pressure roller of the fixing apparatus. FIG. 4 is a drawing for illustrating the fixing apparatus when the fixation roller of the fixing apparatus remains pressed upon the pressure roller of the fixing apparatus.

Referring to FIG. 2, the fixing apparatus 7, which is an example of an image heating apparatus 100, fixes a toner image T on the recording medium P to the recording medium P by conveying the recording medium P through the fixation nip N of the fixing apparatus. That is, as the recording medium P and the toner image T thereon are conveyed through the fixation nip N, heat and pressure are applied to the toner image T and the recording medium P. As a result, the toner image T is melted and welded to the surface of the recording medium P.

After the fixation of the toner image T to the recording medium P, a conveyance roller 42 sends the recording medium P to a lateral delivery tray (C in FIG. 1) or a top delivery tray (D in FIG. 1) by guiding the recording medium P with a recording-medium, guiding top guide 40 and a recording medium guiding bottom guide 41.

A fixation roller 22 is an example of a rotational heating member (image heating device). It is made up of a cylindrical member 22*a*, and an elastic layer 22*b* which covers the entirety of the peripheral surface of the cylindrical member 22*a*. The cylindrical member is made of a metallic substance. The elastic layer is formed of a substance which is lower in thermal conductivity than the cylindrical member. More concretely, the cylindrical member 22*a* is a piece of aluminum cylinder which is 6 mm in thickness. The elastic layer 22*b* is a 3 mm thick silicon rubber layer. The fixation roller 22 has also a separation layer 22*c*, which covers the entirety of the outward surface of the elastic layer 22*b*. The separation layer 22*c* is a piece of PFA tube, which is 100 μm in thickness. The resultant fixation roller 22 is 80 mm in external diameter.

There is a fixation-roller heater 26 in the fixation-roller 22. The fixation roller heater 26 extends virtually from one lengthwise end of the fixation roller 22 to the other through the center portion of the cylindrical member 22*a* of the fixation roller 22. It heats the fixation roller 22 from within the cylindrical member 22*a* by generating heat. The fixation-roller heater 26, which is an example of a heat generating member (heating device), is a halogen heater, which is 1,300 W in total wattage.

A temperature adjustment circuit 43 controls the amount of heat generated by the fixation-roller heater 26, by turning on or off the fixation-roller heater 26 in response to the temperature level detected by a fixation-temperature-level sensor 38, which is an example of a temperature detecting means (temperature detecting device). More specifically, it controls the amount of heat generated by the fixation-roller heater 26, so that the surface temperature of the fixation roller 22 remains as close as possible to a preset proper level. The fixation-temperature-level sensor 38 is of the non-contact type, and detects the temperature of the peripheral surface of the fixation roller 22 at the mid point in terms of the lengthwise direction of the fixation roller 22.

The pressure roller 23, which is an example of a pressure-applying rotational member (nip forming device), is pressed upon the fixation roller 22 so that the fixation nip for thermally processing the recording medium P and the toner image thereon is formed. The pressure roller 23 is made up of a cylindrical member 23*a*, and an elastic layer 23*b* which covers the entirety of the peripheral surface of the cylindrical member 23*a*. The cylindrical member 23*a* is made of iron, and is 3 mm in thickness. The elastic layer 23*b* is formed of silicon rubber, and is a 3 mm thickness. The pressure roller 23 has also a separation layer 23*c*, which covers the entirety of the outward surface of the elastic layer 23*b*. The separation layer 23*c* is a piece of PFA tube, which is 100 μm in thickness. The resultant pressure roller 23 is 60 mm in external diameter.

There is a pressure-roller heater 29 in the pressure roller 23. The pressure-roller heater 29 extends virtually from one lengthwise end of the pressure roller 23 to the other through the center portion of the cylindrical member 23*a* of the pressure roller 23. The pressure-roller heater 29, which is an example of a heat generating member (heating device), is a halogen heater, which is 1,300 W in total wattage.

The temperature adjustment circuit 43 controls the amount of heat generated by the pressure-roller heater 29, by turning on or off the pressure-roller heater 29 in response to the temperature level detected by a pressure-roller-temperature-level sensor 39, which is an example of a temperature detecting means (temperature detecting device). More specifically, it controls the amount of heat generated by the pressure-roller heater 29, so that the surface temperature of the pressure roller 23 remains as close as possible to a preset proper level. The pressure-roller-temperature-level sensor 39 is of the non-contact type, and detects the temperature of the peripheral surface of the pressure roller 23 at the mid point in terms of the lengthwise direction of the pressure roller 23.

The fixation roller 22 is rotatably supported by a pair of bearings 25 solidly attached to the frame 7*a* of the fixing apparatus 7; the shafts extending from the lengthwise ends of the fixation roller 22 are supported by the pair of bearings 25 one for one. It is rotationally driven by an unshown motor. The pressure roller 23 is rotated by the rotation of the fixation roller 22 while remaining pressed upon the fixation roller 22 by a pressing mechanism 7*b*.

The pressure roller 23 is rotatably supported by a pair of bearing 31 solidly attached to the pressing mechanism 7*b* of the fixing apparatus 7; the shafts extending from the lengthwise ends of the pressure roller 23 are supported by the pair of bearings 31 one for one. Not only does the pressing mechanism 7*b* support the pressure roller 23 so that the pressure roller 23 can be placed in contact with, or separated from, the fixation roller 22, but also, the pressing mechanism is enabled to change in multiple steps the amount of pressure applied by the pressure roller 23 upon the fixation roller 22.

Referring to FIG. 3, a control portion 50, which is an example of a target-temperature-level changing means (controlling device, setting device), adjusts the target temperature level for the pressure roller 23 to a level which is lower than that of the fixation roller 22, before the starting of a nonstop heating operation, while the pressure roller 23 is kept separated from the fixation roller 22.

Referring to FIG. 4, the control portion 50 forms the fixation nip N by pressing the pressure roller 23 on the fixation roller 22 immediately before the recording medium P is conveyed between the fixation roller 22 and the pressure roller 23. With this arrangement, the toner image bearing surface of the recording medium P is subjected to a satisfactorily high temperature by the fixation roller 22 without excessively heating the entirety of the recording medium P in terms of its thickness direction. Further, the pressure roller 23, which comes into contact with the bottom surface of the recording medium P, is kept lower in surface temperature than the fixation roller 22. Therefore, it does not occur that the fixed toner image on the bottom surface of the recording medium P melts in an operation in which an image is formed on both surfaces of the recording medium P.

Next, referring to FIG. 2, the pressing mechanism 7*b*, which is an example of the target-temperature-level changing means (controlling device, setting device), is made up of a pair of pressing arms 32, a pair of pressing levers 34, a pair of compression springs 33, a supporting shaft 36, and a pair of pressing cams 35. The pressing arms 32 and the pressing levers 34 are rotationally supported by the supporting shaft 36, with the compression springs 33 disposed between the pressing arms 33 and the pressing levers 34, one for one. The compression-spring supporting end of the pressing levers 34 can be moved upward or downward by changing the angle of the pressing cams 35 by rotating the cams 35. Thus, the pressure roller 23 can be moved upward or downward to change the contact pressure between the pressure roller 23 and fixation roller 22, by rotating the cams 35.

More concretely, each of the pressing arms 32 has a bearing 31 which rotationally supports one of the lengthwise ends of the pressure roller 23, and which is solidly attached to the pressing arm 32. The top end of each of the compression springs 33 is anchored to the corresponding pressing arm 32, and the bottom end of the compression spring 33 is anchored to the corresponding pressing lever 34. The compression spring 33 keeps the pressing arm 32 pressed in the direction to press the pressure roller 23 on the fixation roller 22. Thus, the pressure roller 23 is pressed upon the fixation roller 22 by the pressure from the compression springs 33.

Each of the pressing levers 34 is rotationally supported by the supporting shaft 36 solidly attached to the frame 7*a*. It presses the pressure roller 23 upon the fixation roller 22 while the compression spring 33 remains compressed.

Each cam 35 is disposed so that it remains in contact with the bottom side of the pressing lever 34. As the control portion 50 activates the motor 35*a*, the cam 35 is rotated by the motor 35*a*. As the cam 35 rotates, it rotationally moves the pressing lever 34 upward or downward in multiple steps.

More specifically, as the cam 35 is rotated in the counterclockwise direction, the pressing lever 34 is rotated about the shaft 36 in the clockwise direction, and therefore, the compression spring 33 is compressed. The pressure from the compressed compression spring 33 acts upon the pressing arm 32, whereby the pressure roller 23 is pressed upon the fixation roller 22, creating the fixation nip N between the fixation roller 22 and pressure roller 23.

Referring again to FIG. 2, in a nonstop heating operation for heating a substantial number of sheets of thick paper one after another, 1,000 N of total contact pressure is generated between the fixation roller 22 and the pressure roller 23 by rotating the cam 35, 90 degrees in the counterclockwise direction, which is in the position shown in FIG. 3 in terms of its rotational direction.

Next, referring to FIG. 4, in a nonstop heating operation for heating a substantial number of sheets of thick paper one after another, 1,700 N of total contact pressure is generated between the fixation roller 22 and the pressure roller 23 by rotating the cam 35, 150 degrees in the counterclockwise direction, which is in the position shown in FIG. 3 in terms of its rotational direction. With the increase in the contact pressure in this operation, the heating nip N (fixation nip N) becomes longer in terms of the rotational direction of the fixation roller 22 than that in an operation in which a substantial number of sheets of thin paper are heated one after another.

Next, referring to FIG. 3, as the nonstop heating operation ends, the cam 35 is rotated in the clockwise direction, allowing the pressing lever 34 to rotate in the counterclockwise direction. As a result, the pressure from the compression spring 33 is eliminated. Therefore, the pressure roller 23 separates from the fixation roller 22.

<Mixed-Media-Printing Mode>

Figure 5:
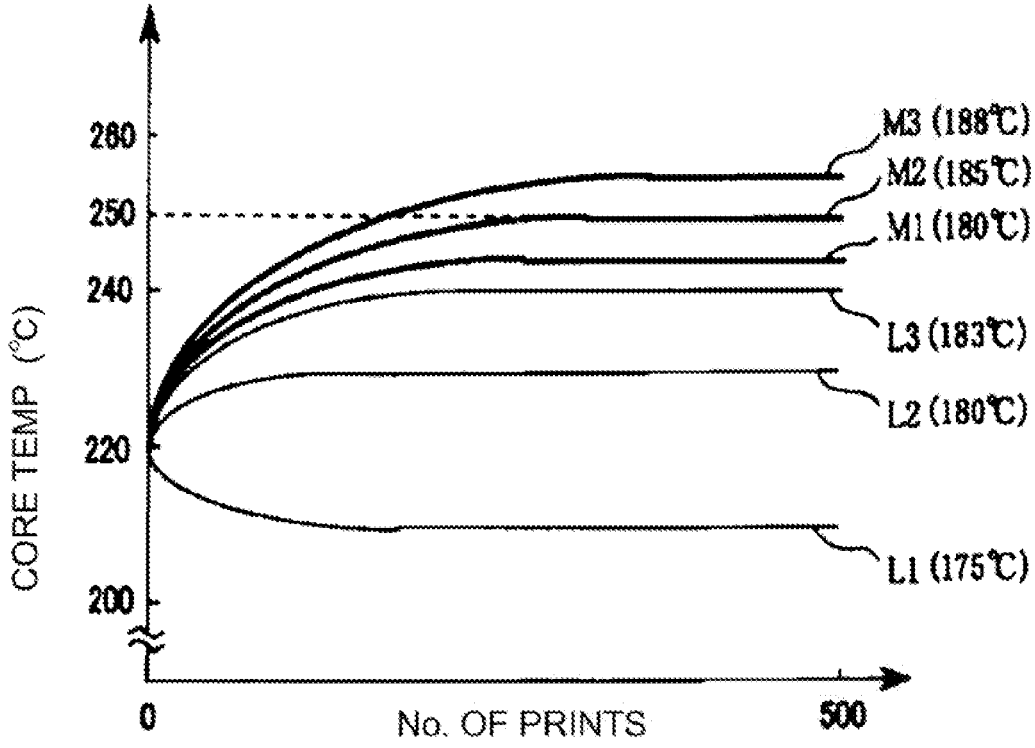
FIG. 5 is a graph of the changes in the temperature of the cylindrical member of the fixation roller, which occurred during an operation in which substantial number of sheets of the recording medium were heated one after another.
Figure 6:
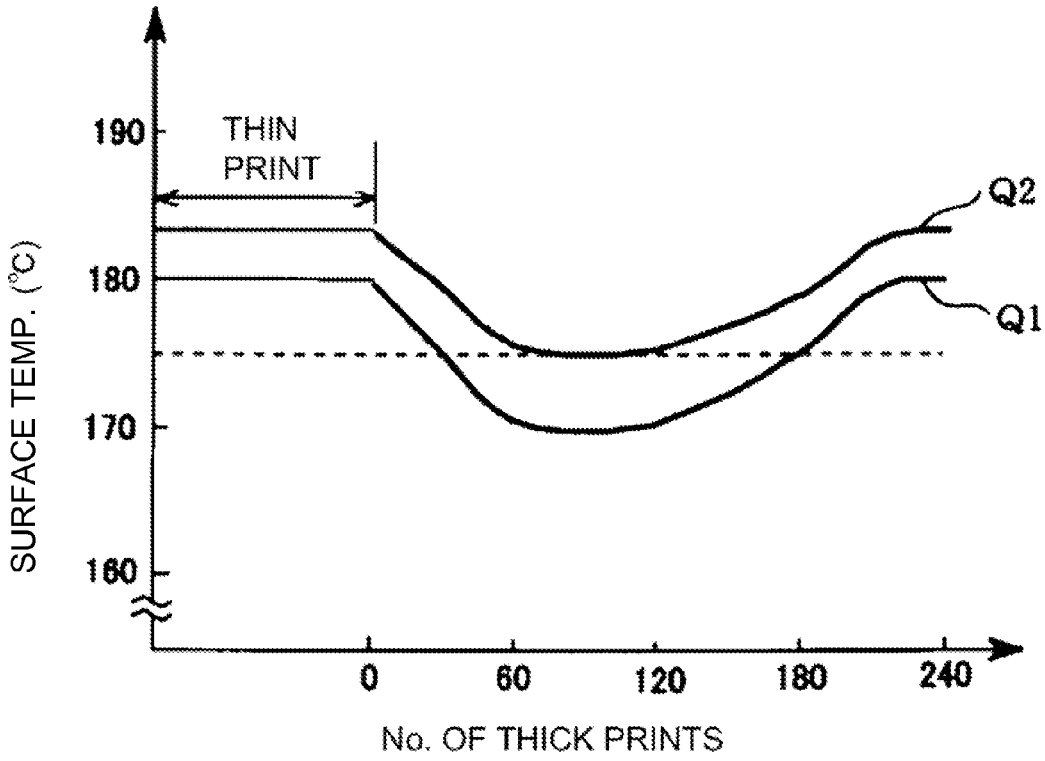
FIG. 6 is a graph of the changes in the surface temperature of the fixation roller, which occurred during an image forming operation in which a substantial number of sheets of the recording medium were heated one after another.

FIG. 5 is a graph of the changes of the temperature of the cylindrical member (metallic core) of the fixation roller 22, which occurred during a nonstop heating operation. FIG. 6 is a graph of the changes of the temperature of the surface temperature of the fixation roller 22, which occurred during a nonstop heating operation.

Referring to FIG. 2, for a nonstop heating operation for heating a substantial number of sheets of thick paper one after another, the control portion 50, which is an example of a selecting device, selects the second mode, whereas for a nonstop operation for heating a mixture of a substantial number of sheets of thin paper and a substantial number of sheets of thick paper, it selects the third mode. Further, for a nonstop heating operation for heating a substantial number of sheets of thin paper, it selects the first mode. The first mode is for heating, nonstop, multiple sheets of a thin recording medium (lower in thermal capacity) one after another. The second mode is for heating, nonstop, multiple sheets of a thick recording medium (higher in thermal capacity) one after another. The third mode is for heating, nonstop, a mixture of multiple sets of multiple sheets of thin paper (lower in thermal capacity) and multiple sets of multiple sheets of thick paper (higher in thermal capacity).

For the second mode, the target temperature level for the fixation roller 22 and the target pressure level for the pressure roller 23 are set higher than those for the first mode, because thick paper is greater in thermal capacity than thin paper, being therefore greater in the amount of heat necessary to heat than thin paper.

Another reason why both the target temperature level for the fixation roller 22 and the target pressure level for the pressure roller 23 are set lower for the first mode than those for the second mode is for extending the service life of the fixation roller 22, and also, for preventing the recording medium P from developing wrinkles.

The higher the target temperature level for the temperature adjustment of the fixation roller 22, the faster the deterioration, and eventual breakage, of the elastic layer 22*b* and the separation layer 22*c* of the fixation roller 22. In other words, the higher the target temperature level, the shorter the service life of the fixation roller 22. For example, as long as the temperature of the cylindrical member 22*a* of the fixation roller 22 is kept no higher than 230 degrees, it is ensured that roughly 1,000,000 sheets P of recording media of A4 size (1,000,000 images) can be conveyed normally before the fixation roller 22 reaches the end of its service life. However, if the target temperature level of the fixation roller 22 is increased to 250 degrees, the service life of the fixation roller 22 decreases to roughly 500,000 sheets P of recording media of A4 size, provided that the recording media are conveyed to be normally positioned.

Therefore, from the standpoint of making the fixation roller 22 last as long as possible, it is desired that in order to keep the temperature of the cylindrical member 22*a* of the fixation roller 22 as low as possible, the target temperature level for the temperature adjustment of the fixation roller 22 is set as low as possible within a range in which the fixing apparatus 7 is ensured in fixing performance.

Further, the higher the pressure applied to the pressure roller 23, the greater the amount of wear to which the fixation roller 22 and the pressure roller 23 are subjected by the recording medium, and therefore, the shorter the service life of the fixation roller 22 and that of the pressure roller 23. The wearing of the fixation roller 22 and the pressure roller 23 is particularly conspicuous at their portions which correspond to the two edges of the recording medium, which are parallel to the recording-medium conveyance direction. More specifically, the portions of the separation layer 22*c* of the fixation roller 22, which correspond in position to the lateral edges of the recording medium in the fixing apparatus 7, are worn away (shaved away) by the lateral edges of the recording medium. As a result, the elastic layer 22*b* becomes exposed, allowing a toner image to adhere to the exposed portions of the elastic layer 22*b*. As a recording medium is conveyed through the fixing apparatus 7, the fixation roller 22, which is covered with the toner as described above, causes the recording medium to be soiled by the toner on the fixation roller 22, on the lateral edge portions. Therefore, even from the standpoint of preventing the fixation roller 22 from being shaved across the portions which correspond in position to the lateral edges of the recording medium which is being conveyed through the fixation nip N, the pressure applied to the pressure roller 23 is desired to be as low as possible within a temperature range in which a toner image is properly fixed.

Figure 9:
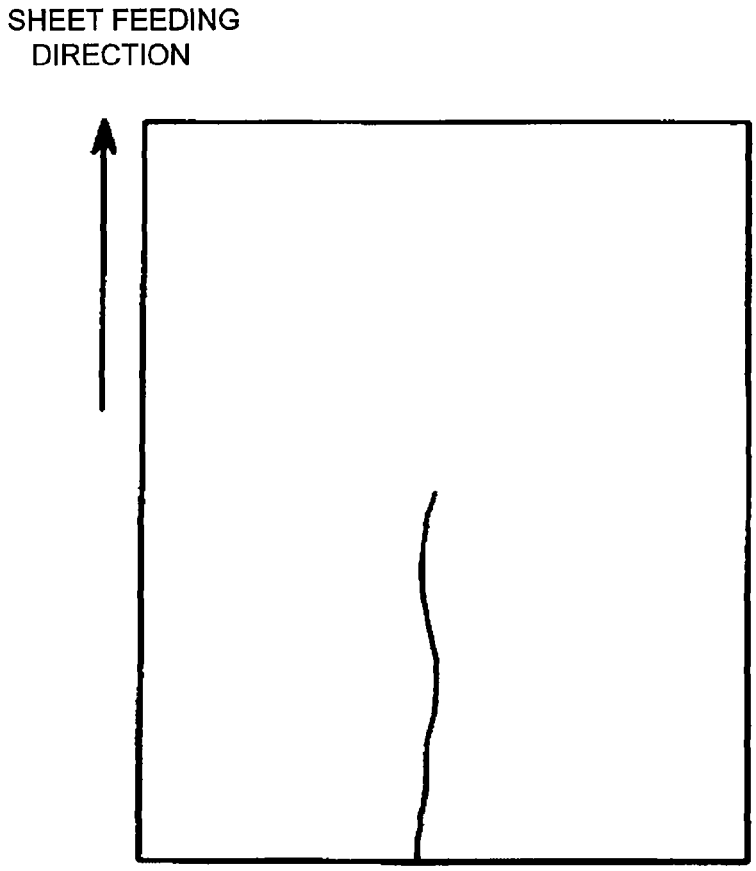
FIG. 9 is a drawing of the wrinkle which occurred to a sheet of the recording medium.

Next, referring to FIG. 9, the higher the pressure applied to the pressure roller 23, the more likely is a recording medium to develop vertical wrinkles across its trailing end portion while it is conveyed through the fixation nip N, in particular, when an image forming operation, in which images are formed nonstop on a substantial number of large sheets of thin paper one after another, is carried out in a highly humid environment. The higher the pressure applied to the pressure roller 23, the more likely it is for a sheet of a recording medium to develop wrinkles across the center portion of its trailing end portion. Therefore, for a printing operation that uses sheets of thin paper, the pressure applied to the pressure roller 23 is desired to be as low as possible in a range in which a toner image is properly fixed.

On the other hand, the third mode (mixed-media-printing mode) is for heating nonstop a mixture of sheets of thick paper and sheets of thin paper under a single fixation condition, with the same image interval (sheet interval), at a high speed. In other words, the third mode is such a mode, the emphasis of which is on productivity.

For the third mode, that is, the mixed-media-printing mode, the pressure applied to the pressure roller 23 is set to the same amount of pressure as that in the second mode. However, the target temperature level for the temperature adjustment of the fixation roller 22 is set to a level that is higher by a step than that for the second mode. That is, the surface temperature of the fixation roller 22 is controlled so that it remains higher than the target temperature level for the second mode that is selected for an operation in which images are formed nonstop on a substantial number of sheets of thick paper.

For the third mode, the target temperature level for the temperature adjustment of the fixation roller 22 is raised. Therefore, in the case of the third mode, even while a substantial number of sheets of thin paper, which require a relatively small amount of heat to heat them, are heated one after another, the temperature of the cylindrical member 22*a* of the fixation roller 22 remains as high as it does in the second mode. Thus, even if a substantial number of sheets of thick paper have to be heated one after another immediately after a substantial number of thin paper were heated one after another, the surface temperature of the fixation roller 22 does not become excessively low. Even if the surface temperature of the fixation roller 22 became lower because a substantial number of sheets of thick paper begin to be heated one after another immediately after the temperature level difference between the peripheral surface of the fixation roller 22 and the cylindrical member 22*a* of the fixation roller 22 became rather small through a nonstop heating operation for heating a substantially number of sheets of thin paper one after another, it does not fall to the level at, or below, which the fixing apparatus 7 cannot satisfactorily fix a toner image and/or makes the toner image unsatisfactorily glossy.

Referring to FIG. 5, as a nonstop heating operation for heating a substantial number of sheets of the recording medium one after another (which hereafter may be referred to simply as a nonstop heating operation) is started, the temperature of the cylindrical member 22*a* of the fixation roller 22 changes in response to the target temperature level for temperature adjustment.

Also referring to FIG. 5, while the fixing apparatus 7 is kept on standby prior to the starting of a nonstop heating operation, the target temperature level for the temperature adjustment of the fixation roller 22 is kept at 200 degrees. During this period, the temperature level of the cylindrical member 22*a* of the fixation roller 22 remains at roughly 220 degrees. In other words, the target temperature level for the temperature adjustment of the fixation roller 22 during a standby period is set higher than that for an actual printing period, for the following reason. That is, the temperature of the cylindrical member 22*a* of the fixation roller 22 is kept slightly higher than the target temperature level for the actual printing operation, even during the standby period, in order to prevent the surface temperature of the fixation roller 22 from drastically falling at the beginning of a printing operation.

Curved lines L1, L2, and L3 in FIG. 5 show the changes in the temperature of the cylindrical member 22*a*, which occurred after the starting of nonstop heating operations in which a substantial number of sheets of thin paper (64 g/m$^2$ in basis weight) were heated one after another, with the pressure to be applied to the pressure roller 23 set to 1,000 N. Curved lines L1, L2, and L3 correspond to 175 degrees, 180 degrees, and 183 degrees, respectively, to which the target temperature level for the temperature adjustment of the fixation roller 22 was switched at the same time as the nonstop heating operations were started.

Curved lines M1, M2, and M3 in FIG. 5 show the changes in the temperature of the cylindrical member 22*a*, which occurred after the starting of nonstop heating operations in which a substantial number of sheets of thick paper (300 g/m$^2$ in basis weight) were heated one after another, with the pressure to be applied to the pressure roller 23 set to 1,000 N. Curved lines M1, M2, and M3 correspond to, 180 degrees, 185 degrees, and 188 degrees, respectively, to which the target temperature level for the temperature adjustment of the fixation roller 22 was switched at the same time as the nonstop heating operations were started.

As shown by curved lines L1-L3, and M1-M3, the greater the recording medium in basis weight, or the higher the target temperature level for the temperature adjustment of the fixation roller 22, the higher the temperature of the cylindrical member 22*a* of the fixation roller 22 became.

Curved line L2 shows the changes in the temperature of the cylindrical member 22*a* in a nonstop heating operation in which sheets of a recording medium are relatively small in basis weight. In the case of this nonstop heating operation, even though the surface temperature of the fixation roller 22 is the same, at 180 degrees, as that in the nonstop heating operation represented by curved line M1, in which sheets of a recording medium were relatively large in basis weight, the temperature of the cylindrical member 22*a* of the fixation roller 22 became roughly 15 degrees lower than in the case of the operation represented by curved line M1.

Thus, if a nonstop heating operation in which sheets of a recording medium that are relatively large in basis weight is started immediately after the temperature of the cylindrical member 22*a* was made to fall to 15 degrees by a nonstop heating operation in which 30 sheets of the recording medium which were relatively small in basis weight were heated one after another, it is impossible for the cylindrical member 22*a* to supply the peripheral surface of the fixation roller 22 with a satisfactory amount of heat fast enough for satisfactory fixation. In other words, in this case, the surface temperature of the fixation roller 22 cannot be maintained as it can in the second mode, that is, the mode in which the temperature of the cylindrical member 22*a* is increased, at the beginning of the operation, to a level high enough to satisfactorily heat, nonstop, a substantial number of sheets of a recording medium that are relatively large in basis weight, and then, is kept at the same level. Thus, the surface temperature of the fixation roller 22 falls by a large amount.

Referring to FIG. 6 as well as FIG. 2, in this case, a nonstop heating operation in which a substantial number of sheets of thick paper, which are 300 g/m$^2$ in basis weight, are heated one after another, was started immediately after a substantial number of sheets of thin paper, which weighs 60 g/m$^2$, were heated one after another. As soon as the operation is started, the surface temperature of the fixation roller 22 fell. In the drawings, curved line Q1 represents a nonstop heating operation in which the target temperature level of the adjustment of the fixation roller 22 was 180 degrees, and curved line Q2 represents a nonstop heating operation in which the target temperature level of the adjustment of the fixation roller 22 was 183 degrees.

As will be evident from FIGS. 6 and 2, as the surface temperature of the fixation roller 22 begins to fall, a fixation-roller heater 26 begins to heat the cylindrical member 22*a* with 1,300 W of power. However, the surface temperature of the fixation roller 22 remains below the target temperature of the temperature adjustment of the fixation roller 22 until the temperature of the cylindrical member 22*a* recovers to the level that is as high as the target temperature level for the cylindrical member 22*a* in the second mode.

In the case of a nonstop heating operation in which the recording media are sheets of thick paper that are 300 g/m$^2$ in basis weight, as long as the surface temperature of the fixation roller 22 remains no lower than 175 degrees, it is within the range in which a toner image is acceptably fixed. However, if it falls below 175 degrees, it is outside the range in which a toner image is acceptably fixed; it is unsatisfactory.

In the case of the nonstop heating operation represented by curved line Q1, the target temperature level for the temperature adjustment of the fixation roller 22 was 180 degrees. However, the surface temperature of the fixation roller 22 fell to roughly 170 degrees, at which a toner image is unlikely to be satisfactorily fixed to a recording medium (the force which keeps toner adhered to recording medium is weak). Therefore, the resultant prints did not meet a preset level of image quality.

On the other hand, in the case of the nonstop heating operation represented by curved line Q2, the target temperature level for the temperature adjustment of the fixation roller 22 was 183 degrees. In this case, the surface temperature of the fixation roller 22 also fell, but it did not fall below 175 degrees, which is within the range in which a toner image is acceptably fixed. Therefore, the resultant prints met a preset level of image quality.

Thus, the target temperature level for the third mode (mixed-media-printing mode) was set to 183 degrees, which is higher by 3 degrees than the target temperature level for the second mode, which is 180 degree, in order to prevent the problem that unsatisfactory fixation occurs in a nonstop heating operation in which the recording media are sheets of thick paper, the basis weight of which is 300 g/m$^2$.

Referring to FIG. 5 as well as FIG. 2, in the third mode (mixed-media-printing mode), the target temperature level of the temperature adjustment of the fixation roller 22 was set higher to 183 degrees, which is higher than the target temperature level for the nonstop heating operation, represented by curved line M1, in which a substantial number of sheets of thick paper, which are 300 g/m$^2$ in basis weight, were heated. The target temperature level for the cylindrical member 22*a* of the fixation roller 22 was set to a level as high as the fixation temperature level (183 degrees) for the nonstop heating operation, represented by curved line L3, in which a substantially number of sheets of thin paper, which are 64 g/m$^2$ in basis weight, are heated.

With this setup, even if a substantial number of sheets of thick paper, which are 300 g/m$^2$ in basis weight, are heated one after another immediately after a substantial number of sheets of thin paper, which are 60 g/m$^2$ in basis weight, are heated one after another, the surface temperature of the fixation roller 22 is kept at a level at which the fixing performance of the fixing apparatus 7 satisfies the preset level of image quality.

Incidentally, the curved lines L1, L2, and L3 in FIG. 5 represent the data of the nonstop heating operations in which the pressure applied to the pressure roller 23 was 1,000 N. However, even if the pressure is increased to 1,700 N, the temperature of the cylindrical member 22*a* of the fixation roller 22 increases by only 2-4 degrees compared to those in the nonstop heating operations represented by curved lines L1, L2, and L3. Thus, the description of the nonstop heating operations represented by curved lines L1, L2, and L3 in FIG. 5 can be substituted for the description of nonstop heating operations in which the pressure applied to the pressure roller 23 is 1,700 N.

In the following embodiments of the present invention, the target temperature levels for the temperature adjustment of the fixation roller 22 for the third mode (mixed-media-printing mode), that is the mode for combinations among various plain papers and coated papers, which are different in basis weight, were set by similarly carrying out experiments. That is, the target temperature levels were set so that the temperature drop that occurs when a nonstop heating operation, to heat a substantial number of sheets of a recording medium that require a relatively large amount of heat to be heated, is started immediately after the temperature of the cylindrical member 22*a* has been made to fall to the lowest level by a nonstop heating operation heating a substantial number of sheets of a recording medium that require a relatively small amount of heat to be heated, does not cause the image forming apparatus to yield prints which are substandard in image quality.

Embodiment 1

Figure 7:
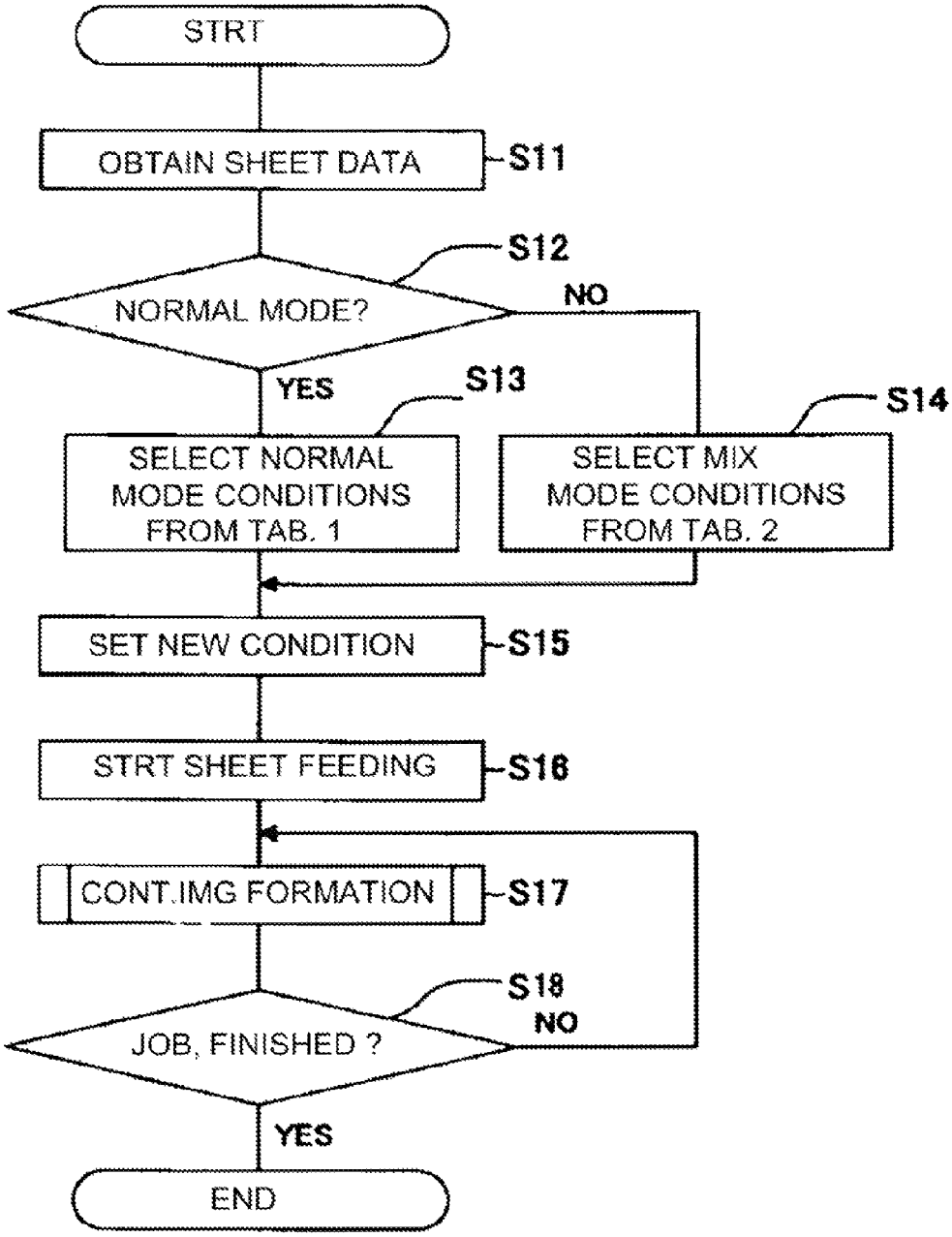
FIG. 7 is a flowchart of the fixing apparatus control in the first embodiment of the present invention.

FIG. 7 is the flow chart for controlling the fixing apparatus in the first embodiment of the present invention.

In the first embodiment, the control portion 50 plays both the role of an information obtaining means for obtaining information regarding the thickness (thermal capacity) of a recording medium during a job in which a substantial number of images are formed nonstop, and the role of a mode-selecting means for selecting one mode from among the first, second, and third modes, in which the fixing apparatus can be operated.

Principally, the ordinary (plain) paper mode, in which the fixing apparatus can be operated in the second mode (for thick plain paper) and the first mode (for thin plain paper), is a mode for a job in which multiple sheets of a recording medium, which are the same in type, are used for image formation. Thus, in a case where after a first job is performed in the ordinary-paper mode, a second job, which uses a different recording-medium type from the first job is performed, the image forming apparatus is temporarily stopped to change its fixation condition (setting), such as the fixation temperature setting, the fixation pressure setting, the image interval setting (recording medium interval setting), etc.

The mixed ordinary paper (plain paper) mode, in which the fixing apparatus can be operated in the third mode, is a mode for a job in which multiple sets of sheets of recording paper, which are different in type, are used nonstop one after another; for example, images are formed nonstop in succession on five sheets of thick plain paper, 30 sheets of thin plain paper, and 5 sheets of thick plain paper (mixed-media-printing job), or image forming in several sections, in each of which images are formed nonstop in succession on five sheets of thick plain paper, 30 sheets of thin plain paper, and 5 sheets of thick plain paper, is performed nonstop (multi-sectional mixed-media-printing mode).

The mixed ordinary-paper mode is a heating mode, the emphasis of which is on productivity. It heats nonstop a mixture of sheets of thick plain paper and sheets of thin plain paper at a high speed, under a single heating condition, with preset image intervals (sheet intervals), regardless of whether each sheet of ordinary paper (plain paper) is thick or thin. The mixed ordinary-paper mode does not require temporarily stopping a heating operation to change the fixation condition and/or image intervals (sheet intervals). Therefore, its productivity is virtually the same as that of the ordinary-paper mode.

In the first embodiment, the information (which represents the basis weight of the recording medium, or whether recording medium is thick paper or thin paper) regarding the recording medium used for nonstop image formation is obtained from the recording-medium data included in a received image-formation job, or recording-medium data inputted through the control panel. Then, the nonstop operation for forming images one after another is started after setting up the fixing apparatus to a fixation condition which matches the information (basis weight) of the recording medium used for the operation.

Next, referring to FIG. 7 as well as FIG. 2, as soon as the control portion 50, which is a recording medium type detecting means, receives an image-formation job, it obtains recording-medium data (recording-medium information) for the entirety of the job (S11).

If all the sheets of the recording medium used for the image-formation job are of the same type, the control portion 50 selects the ordinary-paper mode (YES in S12). If they are a mixture of sheets of recording medium which are different in type, the control portion 50 selects the mix media printing mode for ordinary paper (NO in S12).

If the selected mode is the ordinary-paper mode (YES in S12), the control portion 50 selects the fixation condition which matches the basis weight of the recording medium P used for the operation, and sets the fixing apparatus 7 to the selected fixation condition (S15).

TABLE 1

| Plain Paper/Normal Mode | | | | |
|---|---|---|---|---|
| | Basis weight | Fix. temp. | Pressure | Throughput |
| | $g/m^2$ | ° C. | N | A4Y, ppm |
| Thin 1 | 50-70 | 175 | 1000 | 120 |
| Thin 2 | 71-100 | 178 | 1300 | 120 |
| Thick 1 | 101-200 | 180 | 1500 | 120 |
| Thick 2 | 201-300 | 180 | 1700 | 120 |

Referring to Table 1, in terms of thermal capacity, the relationship among thin paper 1, thin paper 2, thick paper 1, and thick paper 2 in Table 1 is: thin paper 1>thin paper 2>thick paper 1>thick paper 2. The numbers in the fixation temperature column of Table 1 are the values of the target temperature levels for the temperature adjustment of the fixation roller 22. The fixation heater 26 is turned on and off so that the temperature level detected by the fixation temperature sensor 38 remains at, or virtually at, the set target temperature level.

The numbers in the applied pressure column of Table 1 are the values of pressure applied to the pressure roller 23 to keep the peripheral surface of the pressure roller 23 pressed upon the fixation roller 22. The pressure is set in steps to one of these numbers by changing the rotational angle of the pressure application cam 35.

As for the throughput in the first embodiment, the recording medium conveyance speed is set to 600 mm/sec, and the image interval (sheet interval) is set to such a preset value that when sheets of recording medium which are A4 in size are transversely fed, the productivity is 120 ppm.

Referring to Table 1, in an operation in which multiple sheets of recording paper which are 64 $g/m^2$ in basis weight are used as the recording media, the fixation condition for thin paper 1 is selected. In other words, the fixation temperature is set to 170 degrees, and the fixation pressure is set to 1,000 N. Further, the throughput is set to 120 ppm. In comparison, in an operation in which the basis weight of the recording medium is 300 $g/m^2$, the fixation condition for thick paper 2 is selected. In other words, the fixation temperature, fixation pressure, and throughput are set to 180 degrees, 1,700 N, and 120 ppm, respectively.

In an operation in which the recording medium P is thin plain paper, a toner image is satisfactorily fixed even if the amount by which heat is applied to the recording medium P while the recording medium P is conveyed through the fixation nip N is relatively small. Therefore, both the fixation temperature and fixation pressure are set relatively low. In comparison, in an operation in which the recording medium P is thick plain paper, a toner image is not satisfactorily fixed unless the amount by which heat is applied to the recording medium P while the recording medium P is conveyed through the fixation nip N is relatively high. Therefore, both the fixation temperature and the fixation pressure are set relatively high. In terms of throughput, thin paper 1, thin paper 2, thick paper 1, and thick paper 2 in Table 1 are the same.

After the control portion 50 sets the fixation condition for the fixing apparatus 7 (S15), it starts feeding recording media into the main assembly of the image forming apparatus 100 (S16), and makes the image forming apparatus 100 repeatedly form an image (S17) until the job is completed (NO in S18). As soon as the job is completed (YES in S18), it ends the operation for forming nonstop multiple images one after another.

On the other hand, in the ordinary-paper-mixture mode (plain paper) (NO in S12), the control portion 50 selects the fixation condition which matches the basis weight range for the mixture of recording media, from among the fixation conditions in Table 1 (S14), and sets the fixing apparatus 7 to the selected condition (setting) (S15).

TABLE 2

| Plain Paper/Mixed Mode | | | | |
|---|---|---|---|---|
| | Basis weight | Fix. temp. | Pressure | Throughput |
| | g/m$^2$ | ° C. | N | A4Y, ppm |
| Mixed 1 | 50-100 | 178 | 1300 | 120 |
| Mixed 2 | 50-200 | 183 | 1500 | 120 |
| Mixed 3 | 50-300 | 183 | 1700 | 120 |
| Mixed 4 | 101-300 | 180 | 1700 | 120 |

Referring to Table 2, the control portion 50 obtains the information regarding the multiple recording media which are going to be used in mixture, before the image forming apparatus 100 begins to form images in the ordinary-paper-mixture mode.

The control portion 50 obtains the information (basis weight for each of multiple media) regarding the multiple recording media which are going to be used in mixture, and selects the fixation condition which matches the basis weight range for the mixture of multiple recording media, based on the obtained information. That is, the control portion 50 selects the basis weight range which matches the mixture of the multiple recording media in terms of the largest and smallest basis weight, from among mixture 1-mixture 4, and sets the fixing apparatus 7 to the selected fixation condition (setting).

Referring to Table 2, in an operation in which multiple sheets of recording paper which are 64 g/m$^2$ in basis weight, and multiple sheets of recording paper which are 90 g/m$^2$ in basis weight, are used in mixture as recording media, the fixation condition for paper mixture 1 is selected. In other words, the fixation temperature is set to 178 degrees, and the fixation pressure is set to 1,300 N. Further, the throughput is set to 120 ppm.

In an operation in which multiple sheets of recording paper which are 64 g/m$^2$ in basis weight, and multiple sheets of recording paper which are 300 g/m$^2$ in basis weight, are used in mixture as recording media, the fixation condition for paper mixture 3 is selected. In other words, the fixation temperature is set to 183 degrees, and the fixation pressure is set to 1,700 N. Further, the throughput is set to 120 ppm.

Further, in an operation in which multiple sheets of recording paper which are 150 g/m$^2$ in basis weight, and multiple sheets of recording paper which are 300 g/m$^2$ in basis weight, are used in mixture as recording media, the fixation condition for paper mixture 4 is selected. In other words, the fixation temperature is set to 180 degrees, and the fixation pressure is set to 1,700 N. Further, the throughput is set to 120 ppm.

The fixation condition for the paper mixture 1 in Table 2 is the same as that for the thin paper 2 in Table 1. However, the fixation temperature of the fixation condition for the paper mixture 2 and that of the fixation condition for the paper mixture 3 in Table 2 are 183 degrees, which is 3 degrees higher than the fixation temperature (180 degrees) of the fixation condition for the thick paper 1 and that for the thick paper 2.

As described above, if a substantial number of sheets of paper which is 60 g/m$^2$ in basis weight, are heated in succession with the fixation temperature set at 180 degrees, the temperature of the cylindrical member 22*a* of the fixation roller 22 significantly falls. Thus, if a substantial number of sheets of paper which is 300 g/m$^2$ in basis weight are heated in succession with the fixation temperature set at 180 degrees immediately after a substantial number of sheets of paper which is 60 g/m$^2$ in basis weight are heated in succession with the fixation temperature set at 180 degrees, the sheets of paper which are 300 g/m$^2$ in basis weight are likely to be unsatisfactorily fixed.

Therefore, in the paper mixture 3, the fixation temperature is set to 183 degrees, which is 3 degrees higher than that for the thick paper 2 in Table 1, as described above, to increase the temperature of the cylindrical member 22*a* of the fixation roller 22 to prepare for the conveyance of a substantial number of sheets of paper which is 300 g/m$^2$ in basis weight.

Curved line Q1 in FIG. 6 shows the changes in the surface temperature of the fixation roller 22, which occurred when a substantial number of sheets of ordinary paper (plain paper), which is 300 g/m$^2$ in basis weight, were heated in succession after a substantial number of ordinary paper which is 64 g/m$^2$ were heated in succession, starting from the first sheet, under the fixation condition for "thick paper 2" in Table 1.

In the case of the heating operation represented by curved line Q1, the surface temperature of the fixation roller 22 fell to roughly 170 degrees while the substantial number of sheets of a recording medium, which is 300 g/m$^2$ in basis weight, is heated in succession. Therefore, images were unsatisfactorily fixed; the resultant prints did not meet the preset level for image quality.

Curved line Q2 in FIG. 6 shows the changes in the surface temperature of the fixation roller 22, which occurred when a substantial number of sheets of ordinary paper, which is 300 g/m$^2$ in basis weight, were heated in succession after a substantial number of ordinary paper which is 64 g/m$^2$, -were heated in succession under the fixation condition for "thick paper 2" in Table 1. Also in the case of the heating operation represented by curved line Q2, the surface temperature of the fixation roller 22 fell while the substantial number of sheets of the recording medium, which is 300 g/m$^2$ in basis weight, were heated in succession. In this case, however, the surface temperature of the fixation roller 22 did not fall below 175 degrees. Therefore, images were satisfactorily fixed; the resultant prints met the preset level for image quality. Since the fixation temperature was set higher, the temperature of the cylindrical member 22*a* of the fixation roller 22 remained higher during the operation in which a substantial number of sheets of a recording medium which is 64 g/m$^2$ in basis weight were heated in succession. Therefore, the surface temperature of the fixation roller 22 was prevented from being excessively reduced.

The control portion 50 changes the fixation condition of the fixing apparatus 7 (S15), starts the conveyance of recording media (S16), and forms images in succession on the mixture of the sheets of recording papers that are different in basis weight (S17).

As described above, in the first embodiment, the control portion 50 selects the fixation condition in accordance with the information regarding the various recording media (papers) used for the image forming operation which is to be started, and then, operates the image forming apparatus 100 (fixing apparatus 7) in the ordinary-paper-mixture mode. In the mode for forming images on multiple sets of recording paper, which are different in type, the fixing apparatus 7 is not adjusted in fixation temperature, fixation pressure, and throughput while images are printed in succession. Therefore, this mode is higher in productivity than the ordinary mode for ordinary paper. In the "mode for mixture of two or more types of ordinary paper", the fixation temperature and the fixation pressure are set higher than in the "mode for a single type of ordinary paper". Therefore, it has an advantage in terms of productivity improvement, although it is slightly problematic in terms of the durability of the fixation roller 22, and the wrinkles that may occur to thin paper.

Incidentally, in a case where a user is more concerned with the durability of the fixation roller 22 and the wrinkles which might occur to thin paper, than productivity, the fixing apparatus 7 can be set, through the control panel 18, so that it will be operated in the "mode for a single type of ordinary paper", even for an operation in which images are formed nonstop in succession on a mixture of two or more types of ordinary paper.

So far, the embodiment of the present invention was described concerning the basis weight of ordinary paper. However, the fixing apparatus 7 may be designed so that in a case where two or more types of recording media are different in material, surface properties, etc., for example, in a case where images are to be formed on a mixture of a substantial number of sheets of ordinary paper and a substantial number of sheets of glossy paper, the fixing apparatus can be set to "ordinary mode for glossy paper", or "mode for mixture of ordinary paper and glossy paper".

Embodiment 2

Recording-medium information refers to all the information regarding the recording medium, such as the material, the basis weight, the thickness, the count, the surface properties, the electrical resistance, and the like. The control portion 50 as a recording-medium-information detecting means selectively obtains the information necessary to select the proper fixation condition from the recording-medium information, according to the structure of the image forming apparatus 100.

The image forming apparatus 100 may be equipped with a recording-medium-information detecting means which is independent from the control portion 50. In this embodiment, however, the control portion 50 selects the fixation condition, based on the recording-medium information inputted through the control panel 18 from each of the cassettes 9*a*, 9*b*, and 9*c*, and the recording-medium information which is a part of the data of the images to be formed.

Referring to FIG. 1, in the second embodiment, switching is made between the mode for plain paper and the mode for a plain-paper mixture, based on the recording-medium information inputted through the control panel 18, which is made up of a liquid crystal display, a copy button, a numeric keys, etc. The liquid crystal display is provided with a touch panel. The copy button, numeric keys, etc., are around the liquid crystal panel.

More concretely, a user is to manually input the information regarding the recording medium to be used, from among "thin paper which is 50-70 g/m$^2$ in basis weight", "thin paper which is 71-100 g/m$^2$ in basis weight", "thick paper which is 101-200 g/m$^2$ in basis weight", and "thick paper which is 201-300 g/m$^2$ in basis weight", by selectively operating one among the mode selection buttons on the liquid crystal panel of the control panel 18.

As for the material and surface properties of the selected recording medium, a user is to manually input this information by selectively operating one among the buttons for "glossy paper which is 70-100 g/m$^2$ in basis weight", button for "glossy paper which is 100-200 g/m$^2$ in basis weight", and the like, displayed on the liquid crystal panel of the control panel 18, by selectively operating one among the mode selection buttons. The button for each of "OHP medium", "embossable paper which is 70-100 g/m$^2$", "embossable paper which is 101-200 g/m$^2$ in basis weight", "coated intaglio paper which is 70-100 g/m$^2$ in basis weight", and the like, is displayed on the liquid crystal panel of the control panel 18 so that one of them can be selected. That is, in this case, the material, the basis weight, and the surface properties of the selected recording medium are inputted as the recording-medium information.

The information regarding the type of the recording medium in each of the recording-medium cassettes 9*a*, 9*b*, and 9*c* may be inputted in advance so that switching can be made between the mode for plain paper and the mode for mixture of plain papers, based on the information regarding how many sheets of recording medium are to be fed from which cassette.

Embodiment 3

Figure 8:
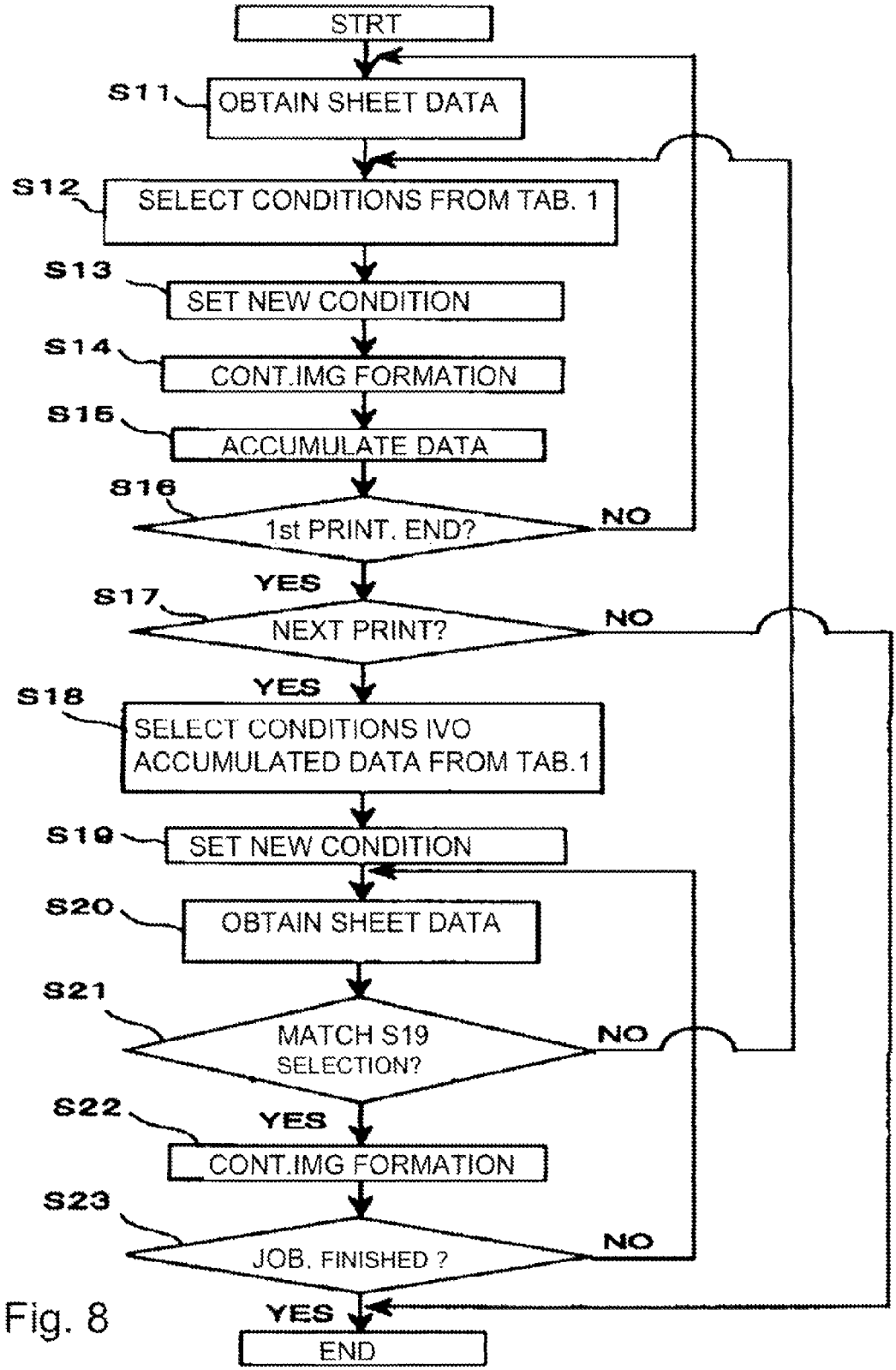
FIG. 8 is a flowchart of the fixing apparatus control in the third embodiment of the present invention.

FIG. 8 is a flowchart of the fixing apparatus control in the third embodiment of the present invention.

This embodiment concerns the mixed-recording-media printing operation. In this operation, the first portion of a nonstop image forming operation is carried out in the mode for plain paper in Table 1 to accumulate (obtain) the information regarding the recording medium. Then, the rest of the image forming operation is carried out in one of the modes for a plain-paper mixture, based on the accumulated information regarding the plain-paper mixture.

More concretely, during the first portion of a nonstop printing operation in which multiple groups of plain paper, which are different in type, are used, sheets of plain paper are heated nonstop in the mode for plain paper while accumulating the information regarding the recording-medium supply (information regarding the recording medium). Then, the second portion, and thereafter, of the nonstop operation are carried out after switching of the mode for plain paper, to the mode for a plain-paper mixture, based on the recording-medium-supply history accumulated during the first portion of the nonstop printing operation.

Here, the printing operation in which multiple groups of recording media, which are different in type, are used, is such a printing operation that multiple sub-operations in which images are printed nonstop and in succession on a group of five sheets of thick paper, a group of 30 sheets of thin paper, and a group of five sheets of thick paper, are carried out nonstop.

Referring to FIG. 7, in principle, even in the third embodiment, whether the printing operation which is going to be started is a printing operation in which a mixture of multiple groups of recording media which are different in type, or a printing operation in which multiple sheets of only one type are used, is determined before the starting of the image formation (S11). Further, in a case where the operational mode is the mixed-media-printing mode, and the recording-medium data (recording-medium information) for the entirety of the job which is going to be done can be obtained, whether the job is to be done in the mode for a plain-paper mixture, or the mode for plain paper of one type is determined based on the obtained data, and the fixing apparatus 7 is set to the determined mode (S15). In a case where the operational mode is the mode for a plain-paper mixture, it is determined which of the fixation conditions for a plain-paper mixture is suitable for the operation, based on the obtained information regarding the recording medium to be used (S14), whereas in a case where the operational mode is the mode for plain paper of one type, it is determined which of the fixation conditions is suitable for the operation (S13), and the fixing apparatus 7 is set to the determined mode. Then, the image forming operation is started.

As described above, in this (third) embodiment, even in a nonstop printing operation in which images are printed nonstop on multiple groups of recording media, which are different in type, the fixing apparatus 7 is operated in the mode for a plain-paper mixture, as described in the explanation of the first embodiment. Therefore, the productivity of the image forming apparatus 100 (fixing apparatus 7) improves.

However, the information regarding the recording medium used for some nonstop image-formation jobs cannot be obtained in its entirety, because of the form in which their image formation data are received. For example, in a case where the data for selecting one of the recording cassettes 9*a*, 9*b*, and 9*c* are parts of the image formation data of one of the groups of the recording medium used for a nonstop printing job, it cannot be determined in advance on which kind of recording medium images are going to be formed.

For example, there are image forming apparatuses designed so that the recording-medium type (from which cassette recording medium is going to be fed) cannot be obtained until immediately before images begin to actually be formed on the recording medium. There are also image forming apparatuses designed so that the image count (print count) cannot be detected until after the image formation on the last recording medium.

In the case of these image forming apparatuses, the information regarding the entirety of the recording media used for a given nonstop printing (image forming) operation can be obtained for the first time by obtaining the recording-medium-conveyance history after the printing operation is started. Therefore, the productivity of these image forming apparatuses can be improved for the printing (image formation) on the second group of recording media, and thereafter, by obtaining the recording-medium information after the printing (image formation) on the first group of recording media is started, and then, selecting one of the fixation conditions, which matches the obtained recording-medium information.

In the case of the third embodiment, if the recording-medium information cannot be obtained in its entirety before the starting of a nonstop printing operation (image forming operation), the first portion of the nonstop printing operation, that is, the portion in which images are formed on the first group of recording media, is carried out in the normal mode for plain paper while accumulating the recording-medium information. Then, the fixation conditions for the second group of recording media and thereafter are selected based on the recording-medium information accumulated while images were printed (formed) on the first group of recording media. Thus, the productivity is improved for the printing (formation) of images on the second group, and thereafter, of recording media, in the nonstop printing operation in which images are printed (formed) on multiple groups of recording media which are different in type. That is, the image forming apparatus in the third embodiment is such an image forming apparatus that can detect the break between adjacent two portions of a nonstop image forming operation.

Referring to FIG. 8 as well as FIG. 2, as the control portion 50 receives an image-formation job, it obtains the data of the recording media which are going to be used for the job (S11).

<Printing Operation in which Multiple Groups of Recording Media Different in Type are not Used>

In the case where a job in which only one type of recording medium is used, the control portion 50 selects the mode for plain paper, and selects the fixation condition which matches the basis weight of the recording medium to be used (S12). Then, it sets the fixing apparatus 7 to the selected fixation condition (S13). Then, it starts feeding the pieces of the recording medium to carry out the nonstop image forming job (S14), while accumulating the data of the recording medium (S15). In the case of a job in which only one type of recording medium is used, the break in the job equals the end of the job (YES in S16), (NO in S17). In other words, as the job reaches a break, it ends. As soon as the image-formation job ends, the accumulated data of the recording medium are eliminated.

Even in the case of a printing operation (job) in which multiple types of recording media are used, if the printing operation (job) uses only one recording-medium group made up of "five sheets of thick paper, 30 sheets of thin paper, and five sheets of thick paper", for example, the control portion 50 determines the fixation condition which matches the basis weight of thick paper, from among the fixation conditions for the ordinary mode for plain paper in Table 1 (S12), and sets the fixing apparatus 7 to the determined fixation condition (S13). As soon as it finishes setting the fixing apparatus (S13), it begins conveying recording media, and makes the image forming apparatus form images nonstop on five sheets of thick paper (S14) one after another while collecting the data of the recording medium (S15).

The completion of the printing of an image on the fifth sheet of thick paper is not the end of the first portion of the nonstop printing operation (job) (NO in S16). Thus, the control portion 50 obtains the data of the next recording medium (thin paper) (S11), and determines the fixation condition which matches the basis weight of the thin paper, from among the fixation conditions for the ordinary mode for plain paper in Table 1 (S12), and sets the fixing apparatus 7 to the determined fixation condition (S13). As soon as it finishes setting the fixing apparatus 7 (S13), it starts conveying the recording media, and makes the image forming apparatus 100 form images nonstop on 30 sheets of thin paper one after another (S14) while collecting the recording-medium data (S15).

The completion of the printing of an image on the 30th sheet of thin paper is not the end of the first portion of the nonstop printing operation (NO in S16). Thus, the control portion 50 obtains the data of the next recording medium (thick paper) (S11), and determines the fixation condition which matches the basis weight of the thick paper, from among the fixation conditions for the ordinary mode for plain paper in Table 1, as it did previously (S12), and sets the fixing apparatus 7 to the determined fixation condition (S13). Then, it makes the image forming apparatus 100 form images nonstop on five sheets of thick paper one after another (S14) while collecting the recording-medium data (S15).

This ends the first portion of the nonstop printing operation (job) (YES in S16). Incidentally, if the nonstop printing operation which uses multiple groups of recording media, which are different in properties, has only one portion, there is no portion to follow (NO in S17). Therefore, the break in the nonstop printing operation (job) equals the end of the operation (job). Thus, the image formation ends at the end of the first portion. As for the collected data of the recording media, they are eliminated at the end of the image formation.

Referring to FIG. 8 which is one of the flowcharts for a nonstop printing operation, in a case where images are not printed on multiple groups of recording media, which are different in properties, the ordinary mode for plain paper is selected as the operational mode for the image forming apparatus 100 (fixing apparatus 7), and the fixation condition is set for each type of recording medium. Then, images are printed following the same operation steps as those shown by Step S13, and thereafter, in FIG. 7 (flowchart).

<Printing Operation in which Multiple Groups of Recording Media Different in Properties are Used>

Let's think about a case of a nonstop printing operation (job) in which multiple portions, in each of which images are printed nonstop on a group of five sheets of thick paper, a group of 30 sheets of thin paper, and a group of five sheets of thick paper one after another. In this case, the control portion 50 obtains recording-medium data (S11) until the first portion of the printing operation ends (NO in S16). Then, it determines the fixation condition which matches the basis weight of the recording medium P, from among the fixation conditions in the abovementioned Table 1 for the ordinary mode for plain paper (S12), and sets the fixing apparatus 7 to the determined fixation condition (S13). Then, it makes the image forming apparatus 100 convey recording media, and forms images (S14) while repeatedly collecting the recording-medium data (S15).

In this case, there is a second portion, and portions thereafter (YES in S17). Therefore, as the first portion of the printing operation ends (YES in S16), the control portion 50 determines the fixation condition which matches the basis weight range of the mixture of recording media P, based on the recording data collected while images were printed during the first portion of the printing operation, from among the mode for plain-paper mixture in Table 2 (S18). Then, it sets the fixing apparatus 7 to the determined fixation condition (S19).

As the control portion 50 finishes to set the fixing apparatus 7 (S19), it sequentially obtains the recording-medium data for the second portion, and portion thereafter, of the printing operation (S20). Then, it confirms whether the fixation condition to which it finished setting the fixing apparatus 7 matches the mode for the recording-media mixture, which was selected in Step S19 (YES in S21). Then, it begins to convey recording media, and repeatedly forms images (S22) until the second portion, and the portions thereafter, (rest of job) of the printing operation are completed (NO in S23). As the rest of the job is completed (YES in S23), the control portion 50 ends the nonstop printing operation. The collected recording-medium data are eliminated at the end of the nonstop printing operation.

If the recording-medium data obtained in Step S20 do not agree with the mode for the recording-media mixture, which was selected in S19 (NO in S21), the control portion 50 removes the collected data, and returns to Step S12, and selects one of the fixation conditions in Table 1, which is for the normal mode, based on the recording-medium data obtained in Step S20 (S12). Then, it sets the fixing apparatus 7 to the selected fixation condition (S13), and forms images.

For the purpose of describing this nonstop image forming operation, it is assumed that 30 copies of an explanatory document, each of which is made up of 50 sheets of thick paper which is 300 g/m$^2$ in basis weight, 30 sheets of thin paper which is 64 g/m$^2$ in basis weight, and five sheets of thick paper which also is 300 g/m$^2$ in basis weight, are printed following FIG. 8 (flowchart).

The recording-medium cassette 9*a* in FIG. 1 is holding multiple sheets of thick paper which is 300 g/m$^2$ in basis weight, and the recording-medium cassette 9*b* in FIG. 1 is holding multiple sheets of thin paper which is 64 g/m$^2$ in basis weight.

In this nonstop printing operation, it is sheets of thick paper which are 300 g/m$^2$ in basis weight, that are conveyed first (S11). Therefore, the control portion 50 selects the fixation condition for thick paper 2 in Table 1 which is for the ordinary mode for plain paper (S12), and sets the fixing apparatus 7 to the fixation condition for thick paper 2 (S13). Then, the control portion 50 forms images nonstop on the five sheets of thick paper which is 300 g/m$^2$ in basis weight under the fixation condition for thick paper 2 for the ordinary mode for plain paper (S14). During this portion of the nonstop printing operation, the control portion 50 counts up the recording-medium data each time a recording medium P which is 300 g/m$^2$ in basis weight is conveyed out of the recording-medium cassette 9*a* (S15).

As soon as images are formed nonstop on the five sheets of thick paper which is 300 g/m$^2$ in basis weight, the control portion 50 checks if there remains a sheet of thick paper in the first group of recording medium (NO in S16). Then, the control portion 50 makes the image forming apparatus 100 begin to convey sheets of thin paper which is 64 g/m$^2$ in basis weight (S11). Thus, it selects the fixation condition for thin paper 1 in Table 1, which is for the ordinary mode for plain paper (S12), and sets the fixing apparatus 7 to the fixation condition for thin paper 1 (S13).

Then, the control portion 50 make image forming apparatus 100 form images nonstop on 30 sheets of thin paper which is 64 g/m$^2$ in basis weight under the fixation condition for thin paper 1 (S14). During this portion of the nonstop printing operation, the control portion 50 counts up data of the recording medium which is 64 g/m$^2$ each time a recording medium P is conveyed out of the recording medium cassette 9*b* (S15).

Even after the images are completed on the 30 sheets of thin paper which is 64 g/m$^2$ in basis weight, a part of the first portion of the nonstop printing operation remains unfinished (NO in S16). Therefore, the control portion 50 makes the image forming apparatus 100 finish the remaining part of the first portion of the nonstop printing operation; it makes the image forming apparatus 100 form images nonstop on five sheets of thick paper, under the fixation condition for thick paper 2 in Table 1 which is for the ordinary mode for plain paper, as described above, thereby finishing the first portion of the nonstop printing operation (YES in S16).

Next, if the nonstop printing operation had a second portion and portions thereafter (YES in S17), the control portion 50 would have counted the 10 sheets of thick paper which is 300 g/m$^2$ in basis weight and 30 sheets of thin paper which is 64 g/m$^2$ in basis weight at the completion of the first portion of the nonstop printing operation. Based on this counting, the control portion 50 selects the fixation condition for mixture 3 in Table 2 which is for the mode for plain-paper mixture (S18).

Then, the control portion 50 switches the fixation condition for the fixing apparatus 7 to the fixation condition for mixture 3 (S19), and makes the image forming apparatus 100 form images nonstop one after another until the second portion, and the portions thereafter, of the nonstop printing operation which is made up of multiple portions, in each of which multiple groups of recording media (paper), which are different in properties, are used, ends (NO in S23) while repeating steps S20-S23. As the last portion of the nonstop printing operation ends (YES in S23), the control portion 50 ends the nonstop printing operation.

As described above, in the case of a nonstop printing operation, the recording-medium information (the material, the basis weight, the print count) of which cannot be obtained in its entirety before the starting of the operation, the first portion of the nonstop printing operation is carried out in the normal mode for plain paper, while collecting the recording-medium information (the material, the basis weight, the print count). If multiple types of recording media are detected during the first portion, then, the fixation conditions for the second portion, and portions thereafter, of the nonstop printing operation are selected based on the recording-medium information accumulated while images were printed (formed) in the first portion. Thus, the productivity is improved for the second portion, and the portions thereafter, of the nonstop printing operation in which multiple types of recording media are used, without sacrificing the fixation for the second portion, and thereafter.

Incidentally, in the case of an image forming apparatus capable of combining inputted multiple jobs, it is possible that images are formed nonstop throughout the combination of nonstop printing jobs A and B, which are made up of multiple portions, in each of which multiple groups of recording media, which are different in their properties, are used. In such a case, the control portion 50 obtains recording-medium data in step S20 and step S21 in FIG. 8, and determines whether the obtained recording-medium data match the current fixation condition of the mode for a plain-paper mixture, for the fixing apparatus 7. If the obtained data do not match the current fixation condition of the fixing apparatus 7 (NO in S21), the control portion 50 eliminates the collected recording-medium data, and collects the new recording-medium data. Then, it makes the image forming apparatus 100 perform a printing job, which is different from the current job, and which also is made up of multiple portions, in each of which multiple groups of recording media, which are different in their properties, are used.

In the current POD (Print On Demand) market, a large number of opportunities are present for printing multiple documents, each of which is made up of pages different in recording-medium type. Therefore, the improvement in productivity, which can be achieved by using the control method in the third embodiment is extremely useful.

Embodiment 4

Glossy coated paper has a flatter surface and is higher in thermal conductivity than plain paper. Therefore, in the case of a printing operation in which sheets of glossy coated paper are used as the recording medium, as a toner image receives heat, the heat disperses into the sheet of glossy coated paper across the interface between the toner image and the sheet of glossy coated paper, making it difficult for the toner image to melt. Therefore, a sheet of thick glossy coated paper and a sheet of thin glossy coated paper require a greater amount of heat to heat them than a sheet of thick plain paper and a sheet of thin plain paper, respectively. Thus, if images are formed nonstop on multiple sheets of thick glossy coated paper immediately after images were formed nonstop on multiple sheets of thin plain paper, the surface temperature of the fixation roller 22 falls far more than it does if images are formed nonstop on multiple sheets of thick plain paper immediately after images were formed nonstop on multiple sheets of thin plain paper.

In the fourth embodiment, therefore, the fixation condition for the ordinary mode for glossy coated paper is made different from the fixation condition for the mode for a mixture of sheets of plain paper and sheets of glossy coated paper.

Table 3 shows the fixation conditions for a nonstop printing job in which images are formed on sheets of only one kind of glossy coated paper (ordinary mode for glossy coated paper).

TABLE 3

| Gloss Coated Sheet/Normal Mode | | | | |
|---|---|---|---|---|
| | Basis weight | Fix. temp. | Pressure | Throughput |
| | g/m$^2$ | ° C. | N | A4Y, ppm |
| Coated 1 | 50-70 | 178 | 1000 | 120 |
| Coated 2 | 71-100 | 180 | 1300 | 120 |
| Coated 3 | 101-200 | 183 | 1500 | 100 |
| Coated 4 | 201-300 | 183 | 1700 | 80 |

The relationship in terms of thermal capacity among coat 1, coat 2, coat 3, and coat 4 in Table 3, and thick paper 1, thin paper 2, thick paper 1 and thick paper 2 in Table 1 in the first embodiment is as follows:

Thin paper 1<coat 1, thin paper 2<coat 2, thick paper 1<coat 3, and thick paper 2<coat 4.

The amount of heat necessary to heat glossy coated paper is greater than the amount of heat necessary to heat plain paper. Therefore, the target levels of fixation temperatures in Table 3 which are for the mode for glossy coated paper are roughly 2-3 degrees higher than the counterparts in Table 1, which is for the modes for plain paper. Further, the throughput for coat 3, and throughput for coat 4, are lower than those for thick paper 1 and thick paper 2. This is for preventing the surface temperature of the fixation roller 22 from falling during a nonstop printing operation in which glossy coated paper is used.

Table 4 shows the fixation conditions of the mode for a mixture of sheets of plain paper and sheets of glossy coated paper, that is, the fixation conditions for a nonstop printing operation in which both plain paper and glossy coated paper are used as recording media.

More specifically, Table 4 shows the fixation conditions for a nonstop printing operation (mode) in which multiple groups of sheets of glossy coated paper, which are different in basis weight, are used, and the fixation conditions for a nonstop printing operation (mode) in which groups of sheets of plain paper and groups of sheets of glossy coated paper, which are different in basis weight, are used as recording media.

TABLE 4

| Plain Paper + Gloss Coated/Mixed Mode | | | | |
|---|---|---|---|---|
| | Basis weight | Fix. temp. | Pressure | Throughput |
| | g/m$^2$ | ° C. | N | A4Y, ppm |
| Mixed 1 | 50-100 | 180 | 1300 | 120 |
| Mixed 2 | 50-200 | 186 | 1500 | 100 |
| Mixed 3 | 50-300 | 186 | 1700 | 80 |
| Mixed 4 | 101-300 | 183 | 1700 | 80 |

Referring to Table 4, the mixed-media-printing mode for a mixture of sheets of plain paper and sheets of glossy coated paper is greater in the amount of heat necessary to heat the recording media than the mixed-media-printing mode for plain paper, which is shown in Table 2. Therefore, the target temperature levels for the temperature adjustment of the fixation roller 22, in Table 4, are 2-3 degrees higher than the counterparts in Table 2.

Referring to FIG. 2, the control portion 50 determines whether the recording medium to be used for a given nonstop printing operation is plain paper, glossy coated paper, or combination of plain paper and glossy coated paper, and also, the basis weight of each recording medium. Then, it selects one of the fixation conditions in Table 1-Table 4. How one of the fixation conditions is selected and assigned based on the basis weight of each recording medium is the same as that in the first or third embodiment.

If both plain paper and glossy coated paper are used, the control portion 50 selects one of the fixation conditions in Table 3 and Table 4. By setting higher the target temperature for the temperature adjustment of the fixation roller 22, the control portion 50 lightens the effects of the surface temperature drop of the fixation roller 22, which occurs as plain paper being used as the recording medium is switched to glossy coated paper, or as multiple sheets of thick glossy coated paper begin to be heated one after another.

Further, the glossy coated paper is flatter on surface, and higher in thermal conductivity than plain paper. Therefore, the amount by which the surface temperature of the fixation roller 22 is dropped by glossy coated paper is substantially larger than that by plain paper. Thus, if the fixation roller 22 is heated so that its surface temperature remains at or near its target temperature level while sheets of glossy coated paper are conveyed one after another, the temperature of the cylindrical member 22*a* of the fixation roller 22 becomes abnormally high. Therefore, in order to prevent the cylindrical member 22*a* of the fixation roller 22 from excessively rising, a nonstop printing operation in which thick glossy coated paper, that is, recording medium which is greater in basis weight, is used as recording medium, is reduced in throughput to lessen the amount by which recording medium robs heat from the fixation roller 22 per unit length of time.

In the case of the fourth embodiment, even in a nonstop printing operation in which a mixture of recording media which are different in material and/or surface properties, for example, a mixture of plain paper and glossy coated paper, is used as recording medium, the information regarding the recording media used for the operation is obtained, and the fixation condition for the operation is determined based on the obtained information. Thus, multiple groups of sheets of recording media, which are different in material, surface properties, and basis weight, are uniformly heated nonstop. Therefore, the fourth embodiment improves a nonstop printing operation in productivity.

Further, in the fourth embodiment, if the fixing apparatus 7 is set to the fixation condition for mixture 3 or 4 in Table 4 in a nonstop printing operation in which sheets of plain paper, and sheets of glossy coated paper which are different in basis weight from the plain paper, are used together, the fixing apparatus 7 reduces in throughput to 80 ppm. Thus, some nonstop printing operation in which sheets of plain paper, and sheets of glossy coated paper different in basis weight from the plain paper, are used together, are higher in productivity if the fixing apparatus 7 is operated in the normal mode than in the mode for a recording-medium mixture, admittedly that it depends on the combination of the length of time necessary to switch the fixation temperature, the types of recording media, and the print count.

In the case of such nonstop printing operations as those described above, a user may operate the button for "not operating in mixture mode", explained in the description of the first embodiment, so that the fixing apparatus 7 will be operated in the normal mode.

In the case of a nonstop printing operation (job) in which a large number of groups of recording media that are different in types, and each group is relatively small in sheet count, the number of times the fixing apparatus 7 has to be changed in fixation temperature, fixation pressure, and throughput, is relatively large. Therefore, operating the fixing apparatus 7 in the mode for a recording-medium mixture makes the fixing apparatus 7 higher in productivity than operating the fixing apparatus 7 in the normal mode. On the other hand, in the case of a nonstop printing operation (job) in which a relatively small number of groups of recording medium, which are different in types, are used, and each group is relatively large in sheet count, the number of times the fixing apparatus 7 has to be changed in fixation temperature, fixation pressure, and throughput is relatively small. In this case, therefore, the fixing apparatus is higher in productivity if the fixation condition therefor is set by using the normal mode, instead of the mixed-media mode.

Therefore, the control portion 50 may be designed so that when the fixing apparatus 7 is operated in the mixed-media mode, that is, the mode for a recording-medium mixture, which changes in throughput, it obtains recording-medium information (which is material, basis weight, sheet count, and surface properties, here); determines whether the fixing apparatus 7 is higher in productivity if it is operated in the mixed-media mode (mode for a recording-medium mixture) or in the normal mode, by calculating the time at which the nonstop printing operation will end if the fixing apparatus 7 is operated in the mixed-media mode, and the time at which the nonstop printing operation will end if the fixing apparatus 7 is operated in the normal mode, based on the obtained recording-medium information; and selects the operational mode for the fixing apparatus 7 based on the determination.

As the recording-medium information, the control portion 50 obtains the material, the basis weight, and the surface properties of the recording medium (sheet of paper) inputted for each of the recording-medium cassettes. As the recording-medium sheet count, the control portion 50 uses the copy count for each job, or the number of sheets of the recording medium conveyed out of each recording-medium cassette.

Embodiment 5

FIG. 9 is a drawing of an example of a wrinkle which occurred as a sheet of a recording medium was conveyed through the fixing apparatus.

Referring to FIG. 9, if the pressure applied to the pressure roller 23 is higher than a certain value, wrinkles are likely to occur to the trailing end portion of a sheet of thin paper, in particular, a large sheet of thin paper, in terms of the sheet-conveyance direction, when the image forming apparatus 100 is operated in a highly humid environment.

The image forming apparatus in the fifth embodiment is provided with a means (51) for detecting the external temperature of the image forming apparatus, and for detecting the external humidity of the image forming apparatus, and can be operated in the first, second, or third mode, based on the results of the detection of the external temperature and humidity by the temperature detecting means and humidity detecting means (51). More concretely, the control portion 50 calculates the amount of moisture in the ambient air of the image forming apparatus, from the output of the temperature-humidity sensor 51. When the amount of humidity in the air is greater than a preset amount, it selects the first or second heating mode for the fixing apparatus.

The control portion 50 calculates the amount of moisture in the ambient air of the image forming apparatus, and the ambient temperature of the image forming apparatus, from the output of the temperature-humidity sensor 51. If it determines, from the result of the calculation, that the image forming apparatus is in an environment in which the recording medium is likely to be wrinkled, it does not use the mixed-media-printing mode if the recording medium is a sheet of thin plain paper, which can be easily wrinkled, because the mixed-media-printing mode is higher in fixation pressure.

In an environment which is high in humidity, it is easier for the recording medium to absorb moisture, and therefore, the rigidity and/or springiness of the recording medium is likely to decrease. With the reduction in the rigidity and/or springiness of the recording medium, it becomes easier for the recording medium to wrinkle. In particular, if a nonstop printing operation in which images are printed on both sides of each sheet of the recording medium is carried out in an environment which is high in humidity, the extent to which the recording medium curls after the printing on the first surface of the recording medium is large, and therefore, it is likely for the recording medium to be wrinkled while the recording medium is conveyed through the fixing apparatus after the printing on the second surface of the recording medium.

Referring to FIG. 1, in the fifth embodiment, the temperature-humidity sensor 51 detects the temperature (degree) and relative humidity (% RH) of the ambience of the image forming apparatus. Then, the control portion 50 calculates the absolute amount of moisture (g/m$^3$) of the ambience, from the output of the temperature-humidity sensor 51. When the calculated absolute amount of moisture matches the definition of a high humidity environment, the control portion 50 uses one of the mixed-media printing modes in Table 5, instead of one of the mixed-media printing modes in Table 2.

TABLE 5

| H. Humidity + Plain Paper/Mixed Mode | | | | |
|---|---|---|---|---|
| | Basis weight | Fix. temp. | Pressure | Throughput |
| | g/m$^2$ | ° C. | N | A4Y, ppm |
| Mixed 1 | 71-200 | 183 | 1500 | 120 |
| Mixed 2 | 71-300 | 183 | 1700 | 120 |
| Mixed 3 | 101-300 | 180 | 1700 | 120 |

Referring to Table 5, if an environment in which the image forming apparatus 100 is operated is high in humidity, and the recording medium used for the operation is thin paper which is no more than 70 g/m$^2$ in basis weight, the apparatus is not to be used in the mixed-media-printing mode.

For example, if a mixture of recording media used as the recording media for a given nonstop printing operation is no higher than 20 g/m$^3$ in the absolute amount of moisture content, the control portion 50 selects one of the fixation conditions in Table 2 which is for the mode for a plain-paper mixture, based on the basis weights of the recording media, as it does in the first embodiment. On the other hand, if a mixture of recording media used as the recording media for a given nonstop printing operation is no less than 20 g/m$^3$ in the absolute amount of moisture content, the control portion 50 selects one of the fixation conditions in Table 5 which is for the mode for a plain-paper mixture and high humidity, based on the basis weights of the recording media.

If the thin plain sheets used in a nonstop printing operation is no less than 20 g/m$^3$ in absolute amount of moisture content, and in a range of 50-70 g/m$^2$ in basis weight, the fixing apparatus is not operated in the mode for a plain-paper mixture. Instead, the fixing apparatus is operated under the fixation condition for thin plain paper 1 (low fixation pressure) in Table 1 which is for the normal mode for plain paper, to prevent the recording media (thin plain papers) from wrinkling.

In the fifth embodiment, if the environment in which the image forming apparatus 100 is operated is high in humidity, and thin plain paper which is 50-70 g/m$^2$ in basis weight is included in the recording media used for a nonstop printing operation, the mixed-media-printing mode (mode for recording media mixture) is not used. The image formation control (recording control) in the fifth embodiment suffers from a disadvantage in that it reduces the productivity of the fixing apparatus. However, it prevents recording media from being wrinkled, having therefore a greater advantage than its disadvantages, in that it can provide high quality images.

On the other hand, if the recording-media mixture used for a nonstop printing operation are 71-300 g/m$^2$ in basis weight, that is, if the recording-media mixture does not include thin plain paper, the recording media are unlikely to be wrinkled. Therefore, the productivity of the fixing apparatus can be increased by selecting one of the fixation conditions in Table 5 which is for the mode for high humidity and a plain-paper mixture, as in the first embodiment.

As described above, in the fifth embodiment, the ambient temperature and humidity of the image forming apparatus 100 are detected, and the mode for a plain-paper mixture is modified based on the detected ambient temperature and humidity. Therefore, not only is thin paper prevented from being wrinkled, but also, the productivity of the fixing apparatus 7 can be improved in a nonstop printing operation in which a mixture of plain papers, which are relatively large in basis weight, are used.

Embodiment 6

In an environment in which the temperature is low, the surface temperature of the recording medium is low, and therefore, the performance of the fixing apparatus 7 is poorer than in an environment in which the temperature is normal. Thus, in an environment in which the temperature is low, a toner image is apt to be unsatisfactorily fixed. More specifically, in an environment in which the temperature is low, the recording medium is prone not to be heated high enough for the toner image thereon to be melted enough to be satisfactorily fixed. Therefore, even slight rubbing of the toner image after the discharging of the recording medium from the fixing apparatus is likely to separate the toner image from the recording medium. In the sixth embodiment, therefore, as the ambient temperature of the image forming apparatus 100 falls, the fixation temperature of the fixing apparatus 7 is set higher to prevent a decrease in the fixing performance of the fixing apparatus.

Referring to FIG. 1, if the ambient temperature detected by the temperature-humidity sensor 51 is no higher than 15 degrees, the control portion 50 sets the fixing apparatus 7 to one of the fixation conditions in Table 6 which is for the normal mode for plain paper, instead of one of the fixation conditions in Table 1 in the first embodiment.

TABLE 6

| L. Humidity + Plain Paper/Normal Mode | | | | |
|---|---|---|---|---|
| | Basis weight | Fix. temp. | Pressure | Throughput |
| | g/m$^2$ | ° C. | N | A4Y, ppm |
| Thin 1 | 50-70 | 180 | 1000 | 120 |
| Thin 2 | 71-100 | 183 | 1300 | 120 |
| Thick 1 | 101-200 | 185 | 1500 | 120 |
| Thick 2 | 201-300 | 185 | 1700 | 120 |

The fixation conditions in Table 6 are higher by five degrees in fixation temperature than the counterparts in Table 1, being therefore greater in the amount of heat with which recording medium is provided, than those in Table 1. Therefore, they can prevent the occurrence of poor fixation in a low temperature environment, by improving the fixing apparatus in the fixation performance in a low temperature environment.

Further, if the ambient temperature detected by the temperature-humidity sensor 51 is no higher than 15 degrees, the control portion 50 sets the fixing apparatus 7 to one of the fixation modes for a plain-paper mixture in Table 7, instead of that in Table 2 for the first embodiment.

TABLE 7

| L. Humidity + Plain Paper/Mixed Mode | | | | |
|---|---|---|---|---|
| | Basis weight | Fix. temp. | Pressure | Throughput |
| | g/m$^2$ | ° C. | N | A4Y, ppm |
| Mixed 1 | 50-100 | 183 | 1300 | 120 |
| Mixed 2 | 50-200 | 188 | 1500 | 120 |
| Mixed 3 | 50-300 | 188 | 1700 | 120 |
| Mixed 4 | 101-300 | 185 | 1700 | 120 |

The fixation temperatures in Table 7 are higher by 5 degrees than those in Table 2, being therefore greater in the amount of heat provided to the recording medium. In other words, unsatisfactory fixation which occurs in a low-temperature environment can be prevented by improving the fixation performance of the fixing apparatus.

However, if the fixation temperature is set to 188 degrees for a nonstop printing (heating) operation in which multiple sheets of thick plain paper which is 300 g/m$^2$ in basis weight are used, as indicated by curved line M3 in FIG. 5, the temperature of the cylindrical member 22*c* of the fixation roller 22 exceeds 250 degrees, and therefore, the fixation roller 22 decreases in durability.

Therefore, in a nonstop printing operation in which the fixation temperature is 188 degrees, and images are formed nonstop on no less than 100 sheets of thick paper, under the fixation conditions in mixture 2 and mixture 3 in Table 7, the fixation temperature is changed from 188 degrees to 185 degrees to prevent the cylindrical member 22*c* from excessively increasing in temperature. Then, if the recording media on which images are formed thereafter are sheets of thin paper, the fixation temperature is switched back from 185 degrees to 188 degrees to prevent the cylindrical member 22*c* from falling in temperature. Therefore, not only is it possible to prevent the problem that the fixation roller 22 is reduced in durability by the increase in the temperature of the cylindrical member 22*c*, which occurs while a substantial number of sheets of thick paper are conveyed nonstop one after another, but also, a substantial number of thick paper sheets can be satisfactorily heated nonstop one after another for image fixation after images are formed nonstop on a substantial number of thin paper sheets one after another.

As described above, in the sixth embodiment, the ambient temperature is detected, and switching is made between the normal mode and the mixed-media mode based on the detected ambient temperature to prevent the unsatisfactory fixation which occurs in an environment in which the temperature is lower than a certain level.

Embodiment 7

In a nonstop printing operation, in the first embodiment, in which images are formed nonstop on a substantial number of sheets of a recording medium, which are different in basis weight, the mode for a plain-paper mixture was unconditionally used to increase the target temperature level for the temperature adjustment of the fixation roller. However, in a case of a nonstop printing operation in which images are formed nonstop on no more than 10 sheets of thin paper one after another, the temperature of the cylindrical member of the fixation roller remains relatively low even after the sheets of thin paper are heated nonstop, and therefore, the surface temperature of the fixation roller 22 does not fall as indicated by curved line Q1 in FIG. 6, even during the subsequent nonstop heating of sheets of thick paper. For example, in the case of a nonstop printing operation in which 30 documents, each of which is made up of one sheet of thin paper which is 60 g/m$^2$ in basis weight and 30 sheets of thick paper which is 300 g/m$^2$ in basis weight, are printed, the number of sheets of thin paper is extremely small compared to that of thick paper. Therefore, the temperature of the cylindrical portion 22*c* of the fixation roller 22 hardly changes during the printing on the sheet of thin paper.

In the seventh embodiment, therefore, in the case of a nonstop image forming operation, in which the number of sheets of a recording medium which is small in the amount of heat necessary to heat them is no higher in its ratio relative to the total number of sheets of the recording medium, the aforementioned preset temperature level in the ordinary mode is used. More concretely, in a nonstop printing operation in which a mixture of sheets of thin paper and sheets of thick paper is used as recording media, and the ratio of the number of sheets of thin paper is lower, the fixing apparatus 7 is operated in the fixation condition 1 (mixture 1) in Table 8 which is for the mode for a plain-paper mixture, which is no higher than 10% in the number of sheets of thin paper, instead of Table 1 in the first embodiment.

TABLE 8

| Less Than 10% of Thin + Plain/Mixed Mode | | | | |
|---|---|---|---|---|
| | Basis weight | Fix. temp. | Pressure | Throughput |
| | g/m$^2$ | ° C. | N | A4Y, ppm |
| Mixed 1 | 50-100 | 178 | 1300 | 120 |
| Mixed 2 | 50-200 | 180 | 1500 | 120 |
| Mixed 3 | 50-300 | 180 | 1700 | 120 |
| Mixed 4 | 101-300 | 180 | 1700 | 120 |

The fixation conditions in Table 8 are lower in fixation temperature than the corresponding fixation conditions in Table 2. In the seventh embodiment, therefore, the temperature of the cylindrical member 22*a* of the fixation roller 22 is prevented from rising as high as that in the first embodiment. Therefore, the seventh embodiment is smaller in the damage to the fixation roller 22; the fixation roller 22 is longer in service life.

Referring to FIG. 1, the control portion 50 detects the sheet count of each of the recording media used in a nonstop printing operation (job). Then, if the number of sheets of thin paper 1 or 2 is no more than 10% of the number of sheets of thick paper 1 or 2, respectively, the fixing apparatus 7 is operated under one of the fixation conditions in Table 8, which is for the mode for a plain-paper mixture which is no higher than 10% in the ratio of the number of sheets of thin paper.

The above-described measure is taken because it was discovered, through studies, that in a case where the ratio of the number of sheets of thin paper 1 or 2 relative to the number of the sheets of thick paper 1 or 2, respectively, is no more than 10%, the temperature of the cylindrical member 22*a* of the fixation roller 22 hardly falls while images are printed on sheets of thin paper 1 or 2.

On the other hand, in a case where the ratio of the number of sheets of thin paper 1 or 2 relative to the number of the sheets of thick paper 1 or 2, respectively, is no less than 10%, the mode for plain-paper mixture, which is in Table 2, is used.

According to the control in the seventh embodiment, in a case where mixture 1 and mixture 3 in Table 8 are applied, the fixation temperature can be reduced by three degrees compared to mixture 2 and mixture 3 in Table 2. Therefore, the service life of the fixation roller 22 can be increased, by reducing the temperature of the cylindrical member 22*a* of the fixation roller 22.

Embodiment 8

In the eighth embodiment, whether the standard mode or the mixture mode is suitable is determined by using the measured values of the thickness of the recording medium. Then, the fixation condition is set based on the determined mode.

Referring to FIG. 1, the recording-medium cassettes 9*a* and 9*b*, for example, are holding sheets of thin plain paper and sheets of thick plain paper, respectively.

An operator inputs the type of the recording medium in the sheet feeder cassette 9*a* and 9*b* as "plain paper", through the control panel 18.

The recording media P conveyed to the registration rollers 13 from the sheet feeder cassettes 9*a* and 9*b* are measured in thickness by a thickness-detecting apparatus 52. The thickness-detecting apparatus 52 makes a pair of metallic rollers pinch the recording medium P, and measures the amount of displacement of the pair of metallic rollers. Then, it outputs the measured value of the thickness of the recording medium.

After refilling the recording-medium cassettes 9*a*, 9*b*, and 9*c* with recording media, an operator carries out the thickness-measurement mode by pressing "recording medium thickness detection print" button of the control panel 18. In the thickness-measurement mode, a sheet of a recording medium P is taken out of each of the recording-medium cassettes 9*a*, 9*b*, and 9*c* in the listed order, and is measured in thickness by the thickness-detecting apparatus 52. Then, the recording media P are discharged from the main assembly of the image forming apparatus, without being used for image formation.

Through the above-described operation, the control portion 50 finds the type (material, surface properties) and thickness (thin paper, thick paper) of the recording media in the recording-medium cassettes 9*a*, 9*b*, and 9*c*.

As the control portion 50 receives an image-formation job, it finds which recording medium is to be used, by searching through the recording medium data. Then, based on the finding, it chooses one of the recording-medium cassettes 9*a*, 9*b*, and 9*c*, as the recording-medium cassette from which recording media are to be taken out. If the designated recording media in the recording-medium data are sheets of thin plain paper, recording media are taken out of the recording-medium cassette 9*a*, and conveyed, whereas if they are sheets of thick plain paper, the recording media are taken out of the recording-medium cassette 9*b*, and conveyed.

If the image-formation job uses only one type of recording medium, the control portion 50 chooses the ordinary mode for plain paper, and sets fixation condition according to the thickness of the recording medium, as shown in Table 9.

TABLE 9

| Plain Paper/Normal Mode | | | | |
|---|---|---|---|---|
| | Basis weight | Fix. temp. | Pressure | Throughput |
| | g/m$^2$ | ° C. | N | A4Y, ppm |
| Thin 1 | 60-90 | 175 | 1000 | 120 |
| Thin 2 | 91-120 | 178 | 1300 | 120 |
| Thick 1 | 121-230 | 180 | 1500 | 120 |
| Thick 2 | 231-350 | 180 | 1700 | 120 |

If two or more types of recording media are included in the image-formation job, the control portion 50 chooses the mixture mode for plain paper, and sets the fixation condition, based on the range of the thickness of the recording media, as shown in Table 10.

TABLE 10

| Plain Paper/Mixed Mode | | | | |
|---|---|---|---|---|
| | Basis weight | Fix. temp. | Pressure | Throughput |
| | g/m$^2$ | ° C. | N | A4Y, ppm |
| Mixed 1 | 60-120 | 178 | 1300 | 120 |
| Mixed 2 | 60-230 | 183 | 1500 | 120 |
| Mixed 3 | 60-350 | 183 | 1700 | 120 |
| Mixed 4 | 121-350 | 180 | 1700 | 120 |

In the case of the control in the eighth embodiment, if the printing job uses a mixture of two or more types of recording media, the control portion 50 chooses the mode for plain-paper mixture, and makes the image forming apparatus carry out the image-formation job strictly under one fixation condition. Therefore, it becomes unnecessary to change the fixation condition each time the recording medium is switched. Therefore, the productivity of the image forming apparatus 100 improves.

In the case of the control in the first embodiment, a user makes the image forming apparatus 100 recognize the type of the recording media in the recording-medium cassettes 9*a*, 9*b*, and 9*c*, by operating the basis weight buttons of the control panel 18. Therefore, if the user operates a wrong basis weight button, the control portion 50 fails to correctly recognize the recording media in the recording-medium cassettes 9*a*, 9*b*, and 9*c*. Thus, it is possible that the image forming operation will be carried out by taking out wrong sheets of the recording medium, and therefore, such a problem as an unsatisfactory fixation or the like will occur.

In comparison, in the case of the control in the eighth embodiment, all that is needed to be done by a user is to input the properties of the recording medium, such as "plain paper", "coated paper", or the like. As the properties of the recording medium is inputted, the thickness of the recording medium is automatically measured by the thickness-detecting device 52 of the image forming apparatus 100. Therefore, the probability with which unsatisfactory fixation or the like will occur due to the usage of the wrong recording medium will decrease.

Further, even if a user forgets to press the "recording medium thickness detection print" button after recording media different from those used for the preceding printing job are set in the recording-medium cassettes 9*a*, 9*b*, and 9*b*, the thickness-detecting apparatus 52 checks the thickness of the recording medium before an image is formed on the first sheet of the recording medium. Thus, if a sheet of a recording medium, the thickness of which is different from the original (preset) values, is detected, it is possible to inform the operator of the error. Or, it is possible, instead, to automatically change the thickness settings for the recording cassettes 9*a*, 9*b*, and 9*c*, and correct the fixation condition (normal mode or mixture mode).

Further, in the eighth embodiment, even when a recording medium, the basis weight of which is unknown, is used, the image forming apparatus 100 can set a proper fixation condition by detecting the thickness of the recording medium. Therefore, it is possible to provide images of high quality.

Even if the wrapping paper in which the sheets of the recording medium to be used came is missing, that is, if what can provide the information about the sheets of the recording medium is the sheets of the recording medium themselves, it is possible for a user to tell whether the recording medium is "plain paper" or "coated paper". However, it is impossible for the user to find out the basis weight and thickness of the recording medium. Therefore, the eighth embodiment is advantageous in such a case.

The numerical values and drawings used for describing the first to eighth embodiments are examples for simplifying the descriptions of the embodiments. In other words, they may be set as necessary according to the structure of the image forming apparatus, structure of the fixing apparatus, their setting, etc.

The application of the present invention is not limited to the image forming apparatuses and fixing apparatuses in the first to eighth embodiments described above. That is, the present invention is applicable to the other types of image forming apparatuses and fixing apparatuses, for example, image forming apparatuses and fixing apparatuses which can be realized by combining two or more of those in the preceding embodiments.

In the case of the structural arrangements in the embodiments described above, if a substantial number of recording media which are relatively small in the amount of heat necessary to heat them is used nonstop, the internal temperature of the rotational heating member becomes higher than the temperature level to which the internal temperature of the rotational heating member reaches when the target temperature level of the second mode, which is set based on the presumption that a substantial number of recording media which is relatively large in the amount of heat necessary to heat them is used nonstop. Therefore, even if the surface temperature of the rotational heating member (roller) falls because a substantial number of recording media which are relatively large in the amount of heat necessary to heat them are used nonstop after a substantial number of sheets of a recording medium which are relatively small in the amount of heat necessary to heat them, the amount of the fall in the surface temperature is not as much as that which occurs if the target temperature level for the second mode is used.

Therefore, it is possible to carry out nonstop a heating operation in which a mixture of sheets of thin plain paper and sheets of thick plain paper is used, without yielding prints which are unsatisfactory in fixation and/or glossiness, as many as will be yielded if the target temperature level for the second mode is used.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 022720/2009 filed Feb. 3, 2009, which is hereby incorporated by reference.

What is claimed is:

1. An image forming apparatus comprising:

an image forming device configured to form a toner image on a sheet;

an image heating device configured to contact the toner image on the sheet and configured to heat the toner image on the sheet;

a heating device configured to heat said image heating device;

a detecting device configured to detect a temperature of said image heating device;

a controlling device configured to control said heating device so that the temperature of said image heating device is maintained at a target temperature based on an output of said detecting device;

a selecting device configured to select one of plurality of modes including a first mode in which the images are continuously formed on a plurality of thin sheets, a second mode in which the images are continuously formed on a plurality of thick sheets, and a third mode in which the images are continuously formed on a plurality of sheets including the thin sheet and the thick sheet; and a setting device configured to set the target temperature based on the selected mode, wherein the target temperature in the second mode is higher than the target temperature in the first mode, and the target temperature in the third mode is higher than the target temperature in the second mode.

2. An image forming apparatus according to claim 1, further comprising a nip forming device configured to form a nip portion with the cooperation of said image heating device, wherein said setting device sets a pressure in the nip portion based on the selected mode, and wherein the pressure in the second mode is higher than the pressure in the first mode, and the pressure in the third mode is substantially equal to the pressure in the second mode.

3. An image forming apparatus according to claim 1, wherein the selecting device is configured to select the first mode in which the images are continuously formed on the plurality of thin sheets having a basis weight not more than 100 g/m$^2$, the second mode in which the images are continuously formed on the plurality of thick sheets having a basis weight not less than 101 g/m$^2$, or the third mode in which the images are continuously formed on a plurality of sheets including the thin sheet having a basis weight not more than 100 g/m$^2$ and the thick sheet having a basis weight not less than 101 g/m$^2$.

4. An image forming apparatus according to claim 1, further comprising a thickness detecting device configured to detect a thickness of the sheet, wherein said selecting device selects one of modes based on an output of said thickness detecting device.

5. An image forming apparatus according to claim 1, wherein said image heating device includes a hollow metal cylinder, an elastic layer provided on said hollow metal cylinder and a parting layer provided on said elastic layer, wherein said heating device is disposed in said hollow metal cylinder, and wherein said controlling device controls said heating device so that an outer surface temperature of said image heating device is maintained at the target temperature based on the output of said detecting device.

6. An image forming apparatus according to claim 1, wherein said image heating device is configured to fix an unfixed toner image, as the toner image, onto the sheet by heat and pressure.

7. An image forming apparatus comprising:

an image forming device configured to form a toner image on a sheet;

an image heating device, disposed so as to contact with the toner image on the sheet, and configured to heat the toner image on the sheet;

a heating device configured to heat said image heating device;

a detecting device configured to detect a temperature of said image heating device;

a heat controlling device configured to control said heating device so that the temperature of said image heating device is maintained at a target temperature based on an output of said detecting device;

a selecting device configured to select one of plurality of modes including a first mode in which the images are continuously formed on a plurality of thin sheets, a second mode in which the images are continuously formed on a plurality of thick sheet, a third mode in which the images are continuously formed on the thick sheets and the thin sheets, the number of thin sheets being larger than the number of the thick sheets, and a fourth mode in which the images are continuously formed on the thin sheets and the thick sheets, the number of thick sheets being larger than the number of the thin sheets; and a setting device configured to set the target temperature based on the selected mode;

wherein the target temperature in the second mode is higher than the target temperature in the first mode, the target temperature in the third mode is substantially equal to the target temperature in the second mode, and the target temperature in the fourth mode is higher than the target temperature in the third mode.

8. An image forming apparatus according to claim 7, wherein the selecting device is configured to select the first mode in which the images are continuously formed on the plurality of thin sheets having a basis weight not more than 100 g/m$^2$, the second mode in which the images are continuously formed on the plurality of thick sheets having a basis weight not less than 101 g/m$^2$, the third mode in which the images are continuously formed on the thick sheets having a basis weight not less than 101 g/m$^2$ and the thin sheets having a basis weight not more than 100 g/m$^2$, the number of thin sheets having a basis weight not more than 100 g/m$^2$ being larger than the number of the thick sheets having a basis weight not less than 101 g/m$^2$, or the fourth mode in which the images are continuously formed on the thin sheets having a basis weight not more than 100 g/m$^2$ and the thick sheets having a basis weight not less than 101 g/m$^2$, the number of thick sheets having a basis weight not less than 101 g/m$^2$ being larger than the number of the thin sheets having a basis weight not more than 100 g/m$^2$.

9. An image forming apparatus according to claim 7, further comprising a thickness detecting device configured to detect a thickness of the sheet, wherein said selecting device selects one of modes based on an output of said thickness detecting device.

10. An image forming apparatus according to claim 7, wherein said image heating device includes a hollow metal cylinder, an elastic layer provided on said hollow metal cylinder and a parting layer provided on said elastic layer, wherein said heating device is disposed in said hollow metal cylinder, and wherein said heat controlling device controls said heating device so that an outer surface temperature of said image heating device is maintained at the target temperature based on the output of said detecting device.

11. An image forming apparatus according to claim 7, wherein said image heating device is configured to fix an unfixed toner image, as the toner image, onto the sheet by heat and pressure.

* * * * *